US011243021B2

(12) United States Patent
Naik et al.

(10) Patent No.: US 11,243,021 B2
(45) Date of Patent: Feb. 8, 2022

(54) ATTACHMENT ARRANGEMENT FOR VACUUM INSULATED DOOR

(71) Applicant: WHIRLPOOL CORPORATION, Benton Harbor, MI (US)

(72) Inventors: Abhay Naik, Stevensville, MI (US); Lakshya Deka, Mishawaka, MI (US); Paul B. Allard, Coloma, MI (US); Jerry M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/192,102

(22) Filed: Nov. 15, 2018

(65) Prior Publication Data

US 2019/0086142 A1 Mar. 21, 2019

Related U.S. Application Data

(63) Continuation of application No. 15/290,723, filed on Oct. 11, 2016, now Pat. No. 10,161,669, which is a (Continued)

(51) Int. Cl.
*F25D 23/02* (2006.01)

(52) U.S. Cl.
CPC ..... *F25D 23/028* (2013.01); *F25D 23/02* (2013.01); *F25D 2201/14* (2013.01); (Continued)

(58) Field of Classification Search
CPC ..... F25D 23/00; F25D 23/02; F25D 23/025; F25D 23/028; F25D 23/04; F25D 23/065; (Continued)

(56) References Cited

U.S. PATENT DOCUMENTS 948,541 A 2/1910 Coleman
1,275,511 A 8/1918 Welch
(Continued)

FOREIGN PATENT DOCUMENTS

CA 626838 A 5/1961
CA 1320631 7/1993
(Continued)

OTHER PUBLICATIONS

Cai et al., "Generation of Metal Nanoparticles By Laser Ablation of Microspheres," J. Aerosol Sci, vol. 29, No. 5/6 (1998), pp. 627-636.
(Continued)

*Primary Examiner* — Andrew M Roersma
(74) *Attorney, Agent, or Firm* — Price Heneveld LLP

(57) ABSTRACT

A refrigerator includes an insulated cabinet structure and a cooling system. A door assembly includes a perimeter structure that is movably mounted to the insulated cabinet structure and an outer door that is movably mounted to the perimeter structure whereby the outer door can be moved between open and closed positions relative to the perimeter structure when the perimeter structure is in its closed position The outer door may comprise a vacuum insulated structure including porous core material disposed in a cavity of the outer door.

2 Claims, 13 Drawing Sheets

Related U.S. Application Data continuation-in-part of application No. 14/639,617, filed on Mar. 5, 2015, now abandoned.

(52) U.S. Cl.
CPC .. *F25D 2323/021* (2013.01); *F25D 2323/023* (2013.01); *F25D 2323/024* (2013.01)

(58) Field of Classification Search
CPC ..... F25D 2201/126; F25D 2201/14; F25D 2323/024; F25D 2323/02; F25D 2323/021; F25D 2323/023; F25D 25/02; Y10T 16/458; Y10T 16/498; Y10T 16/5362; Y10T 16/537; Y10T 16/54038
See application file for complete search history.

(56) References Cited

U.S. PATENT DOCUMENTS 1,849,369 A 3/1932 Frost
1,921,576 A 8/1933 Muffly
2,108,212 A 2/1938 Schellens
2,128,336 A 8/1938 Torstensson
2,164,143 A 6/1939 Munters
2,191,659 A 2/1940 Hintze
2,318,744 A 5/1943 Brown
2,356,827 A 8/1944 Coss
2,432,042 A 12/1947 Richard
2,439,602 A 4/1948 Heritage
2,439,603 A 4/1948 Heritage
2,451,884 A 10/1948 Stelzer
2,538,780 A 1/1951 Hazard
2,559,356 A 7/1951 Hedges
2,644,605 A 7/1953 Palmer
2,729,863 A 1/1956 Kurtz
2,768,046 A 10/1956 Evans
2,792,959 A 5/1957 Diamond et al.
2,809,764 A 10/1957 Diamond
2,817,123 A 12/1957 Jacobs
2,942,438 A 6/1960 Schmeling
2,985,075 A 5/1961 Knutsson-Hall
3,086,830 A 4/1963 Malia
3,125,388 A 3/1964 Costantini et al.
3,137,900 A 6/1964 Carbary
3,218,111 A 11/1965 Steiner
3,258,883 A 7/1966 Louis et al.
3,290,893 A 12/1966 Haldopoulos
3,338,451 A 8/1967 Kesling
3,353,301 A 11/1967 Heilweil et al.
3,353,321 A 11/1967 Heilweil et al.
3,358,059 A 12/1967 Snyder
3,379,481 A 4/1968 Fisher
3,408,316 A 10/1968 Mueller et al.
3,471,416 A 10/1969 Fijal
3,597,850 A 8/1971 Jenkins
3,607,169 A 9/1971 Coxe
3,632,012 A 1/1972 Kitson
3,633,783 A 1/1972 Aue
3,634,971 A 1/1972 Kesling
3,635,536 A 1/1972 Lackey et al.
3,670,521 A 6/1972 Dodge, III et al.
3,688,384 A 9/1972 Mizushima et al.
3,768,687 A 10/1973 Spencer
3,769,770 A 11/1973 Deschamps et al.
3,862,880 A 1/1975 Feldman
3,868,829 A 3/1975 Mann et al.
3,875,683 A 4/1975 Waters
3,910,658 A 10/1975 Lindenschmidt
3,933,398 A 1/1976 Haag
3,935,787 A 2/1976 Fisher
4,005,919 A 2/1977 Hoge et al.
4,006,947 A 2/1977 Haag et al.
4,043,624 A 8/1977 Lindenschmidt
4,050,145 A 9/1977 Benford
4,067,628 A 1/1978 Sherburn
4,084,291 A * 4/1978 Crowe ..... E05D 3/04 16/262
4,118,266 A 10/1978 Kerr
4,170,391 A 10/1979 Bottger
4,242,241 A 12/1980 Rosen et al.
4,260,876 A 4/1981 Hochheiser
4,303,730 A 12/1981 Torobin
4,303,732 A 12/1981 Torobin
4,325,734 A 4/1982 Burrage et al.
4,330,310 A 5/1982 Tate, Jr. et al.
4,332,429 A 6/1982 Frick
4,396,362 A 8/1983 Thompson et al.
4,417,382 A 11/1983 Schilf
4,492,368 A 1/1985 DeLeeuw et al.
4,529,368 A 7/1985 Makansi
4,548,196 A 10/1985 Forobin
4,583,796 A 4/1986 Nakajima et al.
4,660,271 A 4/1987 Lenhardt
4,671,909 A 6/1987 Forobin
4,671,985 A 6/1987 Rodrigues et al.
4,681,788 A 7/1987 Barito et al.
4,745,015 A 5/1988 Cheng et al.
4,777,154 A 10/1988 Torobin
4,781,968 A 11/1988 Kellerman
4,805,293 A 2/1989 Buchser
4,865,875 A 9/1989 Kellerman
4,870,735 A 10/1989 Jahr et al.
4,914,341 A 4/1990 Weaver et al.
4,917,841 A 4/1990 Jenkins
5,007,226 A 4/1991 Nelson
5,018,328 A 5/1991 Cur et al.
5,033,636 A 7/1991 Jenkins
5,066,437 A 11/1991 Barito et al.
5,082,335 A 1/1992 Cur et al.
5,084,320 A 1/1992 Barito et al.
5,094,899 A 3/1992 Rusek, Jr.
5,118,174 A 6/1992 Benford et al.
5,121,593 A 6/1992 Forslund
5,157,893 A 10/1992 Benson et al.
5,168,674 A 12/1992 Molthen
5,171,346 A 12/1992 Hallett
5,175,975 A 1/1993 Benson et al.
5,212,143 A 5/1993 Torobin
5,221,136 A 6/1993 Hauck et al.
5,227,245 A 7/1993 Brands et al.
5,231,811 A 8/1993 Andrepont et al.
5,248,196 A 9/1993 Lynn et al.
5,251,455 A 10/1993 Cur et al.
5,252,408 A 10/1993 Bridges et al.
5,263,773 A 11/1993 Gable et al.
5,273,801 A 12/1993 Barry et al.
5,318,108 A 6/1994 Benson et al.
5,340,208 A 8/1994 Hauck et al.
5,353,868 A 10/1994 Abbott
5,359,795 A 11/1994 Mawby et al.
5,375,428 A 12/1994 LeClear et al.
5,397,759 A 3/1995 Torobin
5,418,055 A 5/1995 Chen et al.
5,433,056 A 7/1995 Benson et al.
5,477,676 A 12/1995 Benson et al.
5,500,287 A 3/1996 Henderson
5,500,305 A 3/1996 Bridges et al.
5,505,810 A 4/1996 Kirby et al.
5,507,999 A 4/1996 Cospey et al.
5,509,248 A 4/1996 Dellby et al.
5,512,345 A 4/1996 Tsutsumi et al.
5,532,034 A 7/1996 Kirby et al.
5,533,311 A 7/1996 Tirrell et al.
5,562,154 A 10/1996 Benson et al.
5,586,680 A 12/1996 Dellby et al.
5,599,081 A 2/1997 Revleti et al.
5,600,966 A 2/1997 Valence et al.
5,632,543 A 5/1997 McGrath et al.
5,640,828 A 6/1997 Reeves et al.
5,643,485 A 7/1997 Potter et al.
5,652,039 A 7/1997 Tremain et al.
5,704,107 A 1/1998 Schmidt et al.
5,716,581 A 2/1998 Tirrell
5,768,837 A 6/1998 Sjoholm

(56) References Cited

U.S. PATENT DOCUMENTS 5,792,539 A 8/1998 Hunter
5,792,801 A 8/1998 Tsuda et al.
5,813,454 A 9/1998 Potter
5,826,780 A 10/1998 Nesser et al.
5,827,385 A 10/1998 Meyer et al.
5,834,126 A 11/1998 Sheu
5,843,353 A 12/1998 De Vos et al.
5,866,228 A 2/1999 Awata
5,866,247 A 2/1999 Klatt et al.
5,868,890 A 2/1999 Fredrick
5,900,299 A 5/1999 Wynne
5,918,478 A 7/1999 Bostic et al.
5,924,295 A 7/1999 Park
5,950,395 A 9/1999 Takemasa et al.
5,952,404 A 9/1999 Simpson et al.
5,966,963 A 10/1999 Kovalaske
5,985,189 A 11/1999 Lynn et al.
6,013,700 A 1/2000 Asano et al.
6,037,033 A 3/2000 Hunter
6,063,471 A 5/2000 Dietrich et al.
6,094,922 A 8/2000 Ziegler
6,109,712 A 8/2000 Haworth et al.
6,128,914 A 10/2000 Tamaoki et al.
6,132,837 A 10/2000 Boes et al.
6,158,233 A 12/2000 Cohen et al.
6,163,976 A 12/2000 Tada et al.
6,164,030 A 12/2000 Dietrich
6,164,739 A 12/2000 Schultz et al.
6,187,256 B1 2/2001 Aslan et al.
6,209,342 B1 4/2001 Banicevic et al.
6,210,625 B1 4/2001 Matsushita et al.
6,217,140 B1 4/2001 Hirath et al.
6,220,473 B1 4/2001 Lehman et al.
6,221,456 B1 4/2001 Pogorski et al.
6,224,179 B1 5/2001 Wenning et al.
6,244,458 B1 6/2001 Frysinger et al.
6,260,377 B1 7/2001 Tamaoki et al.
6,266,941 B1 7/2001 Nishimoto
6,266,970 B1 7/2001 Nam et al.
6,294,595 B1 9/2001 Tyagi et al.
6,305,768 B1 * 10/2001 Nishimoto ..... B29C 44/1242 220/592.09
6,336,693 B2 1/2002 Nishimoto
6,485,122 B2 1/2002 Wolf et al.
6,390,378 B1 5/2002 Briscoe, Jr. et al.
6,406,449 B1 6/2002 Moore et al.
6,408,841 B1 6/2002 Hirath et al.
6,415,623 B1 7/2002 Jennings et al.
6,428,130 B1 8/2002 Banicevic et al.
6,430,780 B1 8/2002 Kim et al.
6,460,955 B1 10/2002 Vaughan et al.
6,519,919 B1 2/2003 Takenouchi et al.
6,623,413 B1 9/2003 Wynne
6,629,429 B1 10/2003 Kawamura et al.
6,689,840 B1 2/2004 Eustace et al.
6,716,501 B2 4/2004 Kovalchuk et al.
6,736,472 B2 5/2004 Banicevic
6,749,780 B2 6/2004 Tobias
6,773,082 B2 8/2004 Lee
6,855,766 B2 2/2005 Oppenheimer-Stix et al.
6,858,280 B2 2/2005 Allen et al.
6,860,082 B1 3/2005 Yamamoto et al.
6,938,968 B2 9/2005 Tanimoto et al.
7,008,032 B2 3/2006 Chekal et al.
7,026,054 B2 4/2006 Ikegawa et al.
7,197,792 B2 4/2007 Moon
7,197,888 B2 4/2007 LeClear et al.
7,207,181 B2 4/2007 Murray et al.
7,210,308 B2 5/2007 Tanimoto et al.
7,234,247 B2 6/2007 Maguire
7,263,744 B2 9/2007 Kim et al.
7,278,279 B2 * 10/2007 Hirai ..... F25D 23/062 312/401
7,284,390 B2 10/2007 Van Meter et al.
7,296,423 B2 11/2007 Müller et al.
7,316,125 B2 1/2008 Uekado et al.
7,343,757 B2 3/2008 Egan et al.
7,360,371 B2 4/2008 Feinauer et al.
7,449,227 B2 11/2008 Echigoya et al.
7,475,562 B2 1/2009 Jackovin
7,517,031 B2 4/2009 Laible
7,614,244 B2 11/2009 Venkatakrishnan et al.
7,625,622 B2 12/2009 Teckoe et al.
7,641,298 B2 1/2010 Hirath et al.
7,665,326 B2 2/2010 LeClear et al.
7,703,217 B2 4/2010 Tada et al.
7,703,824 B2 4/2010 Kittelson et al.
7,757,511 B2 7/2010 LeClear et al.
7,762,634 B2 7/2010 Tenra et al.
7,793,388 B2 * 9/2010 Wing ..... E05B 1/0015 16/412
7,794,805 B2 9/2010 Aumaugher et al.
7,815,269 B2 10/2010 Wenning et al.
7,842,269 B2 11/2010 Schachtely et al.
7,845,745 B2 12/2010 Gorz et al.
7,861,538 B2 1/2011 Welle et al.
7,886,559 B2 2/2011 Hell et al.
7,893,123 B2 2/2011 Luisi
7,908,873 B1 3/2011 Cur et al.
7,930,892 B1 4/2011 Vonderhaar
7,938,148 B2 5/2011 Carlier et al.
7,939,179 B2 5/2011 DeVos et al.
7,992,257 B2 8/2011 Kim
8,049,518 B2 11/2011 Wern et al.
8,074,469 B2 12/2011 Hamel et al.
8,079,652 B2 12/2011 Laible et al.
8,083,985 B2 12/2011 Luisi et al.
8,108,972 B2 2/2012 Bae et al.
8,113,604 B2 2/2012 Olson et al.
8,117,865 B2 2/2012 Allard et al.
8,157,338 B2 4/2012 Seo et al.
8,162,415 B2 4/2012 Hagele et al.
8,163,080 B2 4/2012 Meyer et al.
8,176,746 B2 5/2012 Allard et al.
8,182,051 B2 5/2012 Laible et al.
8,197,019 B2 6/2012 Kim
8,202,599 B2 6/2012 Henn
8,211,523 B2 7/2012 Fujimori et al.
8,266,923 B2 9/2012 Bauer et al.
8,281,558 B2 10/2012 Hiemeyer et al.
8,299,656 B2 10/2012 Allard et al.
8,343,395 B2 1/2013 Hu et al.
8,353,177 B2 1/2013 Adamski et al.
8,382,219 B2 2/2013 Hottmann et al.
8,434,317 B2 5/2013 Besore
8,439,460 B2 5/2013 Laible et al.
8,456,040 B2 6/2013 Allard et al.
8,486,215 B2 7/2013 Amann
8,491,070 B2 7/2013 Davis et al.
8,516,845 B2 8/2013 Wuesthoff et al.
8,528,284 B2 9/2013 Aspenson et al.
8,590,992 B2 11/2013 Lim et al.
8,717,029 B2 5/2014 Chae et al.
8,739,568 B2 6/2014 Allard et al.
8,752,918 B2 6/2014 Kang
8,752,921 B2 6/2014 Gorz et al.
8,763,847 B2 7/2014 Mortarotti
8,764,133 B2 7/2014 Park et al.
8,770,682 B2 7/2014 Lee et al.
8,776,390 B2 7/2014 Hanaoka et al.
8,840,204 B2 9/2014 Bauer et al.
8,852,708 B2 10/2014 Kim et al.
8,871,323 B2 10/2014 Kim et al.
8,881,398 B2 11/2014 Hanley et al.
8,905,503 B2 12/2014 Sahasrabudhe et al.
8,943,770 B2 2/2015 Sanders et al.
8,944,541 B2 2/2015 Allard et al.
9,009,969 B2 4/2015 Choi et al.
RE45,501 E 5/2015 Maguire
9,056,952 B2 6/2015 Eilbracht et al.
9,062,480 B2 6/2015 Litch
9,074,811 B2 7/2015 Korkmaz
9,080,808 B2 7/2015 Choi et al.
9,102,076 B2 8/2015 Doshi et al.

(56) References Cited

U.S. PATENT DOCUMENTS 9,103,482 B2 8/2015 Fujimori et al.
9,125,546 B2 9/2015 Kleemann et al.
9,140,480 B2 9/2015 Kuehl et al.
9,140,481 B2 9/2015 Cur et al.
9,170,045 B2 10/2015 Oh et al.
9,170,046 B2 10/2015 Jung et al.
9,188,382 B2 11/2015 Kim et al.
8,955,352 B2 12/2015 Lee et al.
9,221,210 B2 12/2015 Wu et al.
9,228,386 B2 1/2016 Thielmann et al.
9,267,727 B2 2/2016 Lim et al.
9,303,915 B2 4/2016 Kim et al.
9,328,951 B2 5/2016 Shin et al.
9,353,984 B2 5/2016 Kim et al.
9,410,732 B2 8/2016 Choi et al.
9,423,171 B2 8/2016 Betto et al.
9,429,356 B2 8/2016 Kim et al.
9,448,004 B2 9/2016 Kim et al.
9,463,917 B2 10/2016 Wu et al.
9,482,463 B2 11/2016 Choi et al.
9,506,689 B2 11/2016 Carbajal et al.
9,518,777 B2 12/2016 Lee et al.
9,568,238 B2 2/2017 Kim et al.
D781,641 S 3/2017 Incukur
D781,642 S 3/2017 Incukur
9,605,891 B2 3/2017 Lee et al.
9,696,085 B2 7/2017 Seo et al.
9,702,621 B2 7/2017 Cho et al.
9,759,479 B2 9/2017 Ramm et al.
9,777,958 B2 10/2017 Choi et al.
9,791,204 B2 10/2017 Kim et al.
9,833,942 B2 12/2017 Wu et al.
9,927,169 B2 3/2018 Baker et al.
9,976,753 B2 5/2018 Hynes
10,024,544 B2 7/2018 Bhogal et al.
10,077,342 B2 9/2018 An et al.
10,161,669 B2 * 12/2018 Naik ..... F25D 23/028
2002/0004111 A1 1/2002 Matsubara et al.
2002/0114937 A1 8/2002 Albert et al.
2002/0144482 A1 10/2002 Henson et al.
2002/0168496 A1 11/2002 Morimoto et al.
2003/0008100 A1 1/2003 Horn
2003/0041612 A1 3/2003 Piloni et al.
2003/0056334 A1 3/2003 Finkelstein
2003/0157284 A1 8/2003 Tanimoto et al.
2003/0167789 A1 9/2003 Tanimoto et al.
2003/0173883 A1 9/2003 Koons
2004/0144130 A1 7/2004 Jung
2004/0178707 A1 9/2004 Avendano et al.
2004/0180176 A1 9/2004 Rusek
2004/0226141 A1 11/2004 Yates et al.
2004/0253406 A1 12/2004 Hayashi et al.
2005/0042247 A1 2/2005 Gomoll et al.
2005/0229614 A1 10/2005 Ansted
2005/0235682 A1 10/2005 Hirai et al.
2006/0064846 A1 3/2006 Espendola et al.
2006/0076863 A1 4/2006 Echigoya et al.
2006/0200948 A1 * 9/2006 Steurer ..... E05B 1/0015 16/412
2006/0201189 A1 9/2006 Adamski et al.
2006/0261718 A1 11/2006 Miseki et al.
2006/0263571 A1 11/2006 Tsunetsugu et al.
2006/0266075 A1 11/2006 Itsuki et al.
2007/0001563 A1 1/2007 Park et al.
2007/0099502 A1 5/2007 Ferinauer et al.
2007/0176526 A1 8/2007 Gomoll et al.
2007/0266654 A1 11/2007 Noale
2008/0044488 A1 2/2008 Zimmer et al.
2008/0048540 A1 2/2008 Kim
2008/0138458 A1 6/2008 Ozasa et al.
2008/0196441 A1 8/2008 Ferreira
2008/0300356 A1 12/2008 Meyer et al.
2008/0309210 A1 12/2008 Luisi et al.
2009/0032541 A1 2/2009 Rogala et al.
2009/0056367 A1 3/2009 Nuemann
2009/0058244 A1 3/2009 Cho et al.
2009/0113925 A1 5/2009 Korkmaz
2009/0131571 A1 5/2009 Fraser et al.
2009/0151124 A1 * 6/2009 Forrest ..... E05D 5/14 16/374
2009/0179539 A1 * 7/2009 Henriksson ..... E05F 5/06 312/405
2009/0179541 A1 7/2009 Smith et al.
2009/0205357 A1 8/2009 Lim et al.
2009/0302728 A1 12/2009 Rotter et al.
2009/0322470 A1 12/2009 Yoo et al.
2009/0324871 A1 12/2009 Henn
2010/0170279 A1 7/2010 Aoki
2010/0206464 A1 8/2010 Heo et al.
2010/0218543 A1 9/2010 Duchame
2010/0231109 A1 9/2010 Matzke et al.
2010/0287843 A1 11/2010 Oh
2010/0287974 A1 11/2010 Cur et al.
2010/0293984 A1 11/2010 Adamski et al.
2010/0295435 A1 11/2010 Kendall et al.
2011/0011119 A1 1/2011 Kuehl et al.
2011/0023527 A1 2/2011 Kwon et al.
2011/0030894 A1 2/2011 Tenra et al.
2011/0095669 A1 4/2011 Moon et al.
2011/0146325 A1 6/2011 Lee
2011/0146335 A1 6/2011 Jung et al.
2011/0165367 A1 7/2011 Kojima et al.
2011/0215694 A1 9/2011 Fink et al.
2011/0220662 A1 9/2011 Kim et al.
2011/0241513 A1 10/2011 Nomura et al.
2011/0241514 A1 10/2011 Nomura et al.
2011/0260351 A1 10/2011 Corradi et al.
2011/0290808 A1 12/2011 Bai et al.
2011/0309732 A1 12/2011 Horil et al.
2011/0315693 A1 12/2011 Cur et al.
2012/0000234 A1 1/2012 Adamski et al.
2012/0011879 A1 1/2012 Gu
2012/0060544 A1 3/2012 Lee et al.
2012/0099255 A1 4/2012 Lee et al.
2012/0103006 A1 5/2012 Jung et al.
2012/0104923 A1 5/2012 Jung et al.
2012/0118002 A1 5/2012 Kim et al.
2012/0137501 A1 6/2012 Allard et al.
2012/0152151 A1 6/2012 Meyer et al.
2012/0196059 A1 8/2012 Fujimori et al.
2012/0202049 A1 8/2012 Valladeau et al.
2012/0231204 A1 9/2012 Jeon et al.
2012/0237715 A1 9/2012 McCraken
2012/0240612 A1 9/2012 Wusthoff et al.
2012/0273111 A1 11/2012 Nomura et al.
2012/0279247 A1 11/2012 Katu et al.
2012/0280608 A1 11/2012 Park et al.
2012/0285971 A1 11/2012 Junge et al.
2012/0297813 A1 11/2012 Hanley et al.
2012/0324937 A1 12/2012 Adamski et al.
2013/0026900 A1 1/2013 Oh et al.
2013/0033163 A1 2/2013 Kang
2013/0043780 A1 2/2013 Ootsuka et al.
2013/0068990 A1 3/2013 Eilbracht et al.
2013/0111941 A1 5/2013 Yu et al.
2013/0221819 A1 8/2013 Wing
2013/0255304 A1 10/2013 Cur et al.
2013/0256318 A1 10/2013 Kuehl et al.
2013/0256319 A1 10/2013 Kuehl et al.
2013/0257256 A1 10/2013 Allard et al.
2013/0257257 A1 10/2013 Cur et al.
2013/0264439 A1 10/2013 Allard et al.
2013/0270732 A1 10/2013 Wu et al.
2013/0285527 A1 10/2013 Choi et al.
2013/0293080 A1 11/2013 Kim et al.
2013/0305535 A1 11/2013 Cur et al.
2013/0328472 A1 12/2013 Shim et al.
2014/0009055 A1 1/2014 Cho et al.
2014/0033759 A1 * 2/2014 Ide ..... F25D 23/062 62/457.2
2014/0047775 A1 2/2014 Litch
2014/0097733 A1 4/2014 Seo et al.
2014/0132144 A1 * 5/2014 Kim ..... F25D 23/028 312/405

(56) References Cited

U.S. PATENT DOCUMENTS

| | | | | |
|---|---|---|---|---|
| 2014/0166926 | A1 | 6/2014 | Lee et al. | |
| 2014/0171578 | A1 | 6/2014 | Meyer et al. | |
| 2014/0190978 | A1 | 7/2014 | Bowman et al. | |
| 2014/0196305 | A1 | 7/2014 | Smith | |
| 2014/0216706 | A1 | 8/2014 | Melton et al. | |
| 2014/0232250 | A1 | 8/2014 | Kim et al. | |
| 2014/0260332 | A1 | 9/2014 | Wu | |
| 2014/0311667 | A1 | 10/2014 | Siudzinski et al. | |
| 2014/0346942 | A1* | 11/2014 | Kim | F25D 23/067 312/404 |
| 2014/0364527 | A1 | 12/2014 | Wintermantel et al. | |
| 2015/0011668 | A1 | 1/2015 | Kolb et al. | |
| 2015/0015133 | A1 | 1/2015 | Carbajal et al. | |
| 2015/0017386 | A1 | 1/2015 | Kolb et al. | |
| 2015/0027628 | A1 | 1/2015 | Cravens et al. | |
| 2015/0047624 | A1 | 2/2015 | Luckhardt et al. | |
| 2015/0059399 | A1 | 3/2015 | Hwang et al. | |
| 2015/0115790 | A1 | 4/2015 | Ogg | |
| 2015/0147514 | A1 | 5/2015 | Shinohara et al. | |
| 2015/0159936 | A1 | 6/2015 | Oh et al. | |
| 2015/0168050 | A1 | 6/2015 | Cur et al. | |
| 2015/0176888 | A1 | 6/2015 | Cur et al. | |
| 2015/0184923 | A1 | 7/2015 | Jeon | |
| 2015/0190840 | A1 | 7/2015 | Muto et al. | |
| 2015/0224685 | A1 | 8/2015 | Amstutz | |
| 2015/0241115 | A1 | 8/2015 | Strauss et al. | |
| 2015/0241118 | A1 | 8/2015 | Wu | |
| 2015/0285551 | A1 | 10/2015 | Aiken et al. | |
| 2016/0084567 | A1 | 3/2016 | Fernandez et al. | |
| 2016/0116100 | A1 | 4/2016 | Thiery et al. | |
| 2016/0123055 | A1 | 5/2016 | Ueyama | |
| 2016/0161175 | A1 | 6/2016 | Benold et al. | |
| 2016/0178267 | A1 | 6/2016 | Hao et al. | |
| 2016/0178269 | A1 | 6/2016 | Hiemeyer et al. | |
| 2016/0235201 | A1 | 8/2016 | Soot | |
| 2016/0240839 | A1 | 8/2016 | Umeyama et al. | |
| 2016/0258671 | A1 | 9/2016 | Allard et al. | |
| 2016/0290702 | A1 | 10/2016 | Sexton et al. | |
| 2016/0348957 | A1 | 12/2016 | Hitzelberger et al. | |
| 2017/0038126 | A1 | 2/2017 | Lee et al. | |
| 2017/0157809 | A1 | 6/2017 | Deka et al. | |
| 2017/0159942 | A1 | 6/2017 | Ivanovic et al. | |
| 2017/0176086 | A1 | 6/2017 | Kang | |
| 2017/0184339 | A1 | 6/2017 | Liu et al. | |
| 2017/0191746 | A1 | 7/2017 | Seo | |

FOREIGN PATENT DOCUMENTS

| | | | | |
|---|---|---|---|---|
| CA | 2259665 | | 1/1998 | |
| CA | 2640006 | | 8/2007 | |
| CN | 1158509 | | 9/1997 | |
| CN | 1970185 | | 5/2007 | |
| CN | 100359272 | | 1/2008 | |
| CN | 101437756 | | 5/2009 | |
| CN | 201680116 | | 12/2010 | |
| CN | 201748744 | U | 2/2011 | |
| CN | 102296714 | | 12/2011 | |
| CN | 102452522 | | 5/2012 | |
| CN | 102717578 | A | 10/2012 | |
| CN | 102720277 | | 10/2012 | |
| CN | 103072321 | | 5/2013 | |
| CN | 202973713 | U | 6/2013 | |
| CN | 203331442 | | 12/2013 | |
| CN | 104816478 | A | 8/2015 | |
| CN | 105115221 | | 12/2015 | |
| CN | 204963379 | U | 1/2016 | |
| DE | 1150190 | | 6/1963 | |
| DE | 4110292 | A1 | 10/1992 | |
| DE | 4409091 | | 9/1995 | |
| DE | 19818890 | | 11/1999 | |
| DE | 19914105 | | 9/2000 | |
| DE | 19915311 | | 10/2000 | |
| DE | 19948361 | | 4/2001 | |
| DE | 102008026528 | | 12/2009 | |
| DE | 102009046810 | | 5/2011 | |
| DE | 102010024951 | | 12/2011 | |
| DE | 102011075714 | A1 * | 11/2012 | F25D 23/028 |
| DE | 102011051178 | A1 | 12/2012 | |
| DE | 102012223536 | | 6/2014 | |
| DE | 102012223541 | | 6/2014 | |
| DE | 102013010146 | A1 * | 12/2014 | F25D 23/028 |
| EP | 0480451 | | 4/1992 | |
| EP | 0645576 | A1 | 3/1995 | |
| EP | 0691518 | | 1/1996 | |
| EP | 0260699 | | 3/1998 | |
| EP | 0860669 | | 8/1998 | |
| EP | 0927804 | A2 * | 7/1999 | E05D 5/06 |
| EP | 1087186 | | 3/2001 | |
| EP | 1200785 | | 5/2002 | |
| EP | 1243880 | | 9/2002 | |
| EP | 1484563 | | 12/2004 | |
| EP | 1496322 | | 1/2005 | |
| EP | 1505359 | | 2/2005 | |
| EP | 1602425 | A1 | 12/2005 | |
| EP | 1624263 | A2 | 8/2006 | |
| EP | 1344008 | | 9/2006 | |
| EP | 1338854 | | 12/2009 | |
| EP | 2543942 | A2 | 1/2013 | |
| EP | 2607073 | | 6/2013 | |
| EP | 2789951 | | 10/2014 | |
| EP | 2801774 | | 11/2014 | |
| EP | 2878427 | A1 | 6/2015 | |
| FR | 2980963 | | 4/2013 | |
| FR | 2991698 | A1 | 12/2013 | |
| GB | 837929 | | 6/1960 | |
| GB | 1214548 | | 12/1970 | |
| JP | S4828353 | | 8/1973 | |
| JP | S5157777 | | 5/1976 | |
| JP | S59191588 | | 12/1984 | |
| JP | 04165197 | | 10/1992 | |
| JP | 04309778 | A | 11/1992 | |
| JP | H06159922 | | 6/1994 | |
| JP | H071479 | | 1/1995 | |
| JP | H07167377 | | 7/1995 | |
| JP | 8145547 | | 6/1996 | |
| JP | H08300052 | | 11/1996 | |
| JP | H08303686 | | 11/1996 | |
| JP | H09166271 | | 6/1997 | |
| JP | H10113983 | | 5/1998 | |
| JP | 11159693 | A | 6/1999 | |
| JP | H11311395 | | 11/1999 | |
| JP | H11336990 | | 12/1999 | |
| JP | 2000097390 | | 4/2000 | |
| JP | 20000117334 | | 4/2000 | |
| JP | 2000320958 | A | 11/2000 | |
| JP | 2001038188 | | 2/2001 | |
| JP | 2001116437 | | 4/2001 | |
| JP | 2001336691 | | 12/2001 | |
| JP | 2001343176 | | 12/2001 | |
| JP | 2002068853 | | 3/2002 | |
| JP | 3478771 | | 12/2003 | |
| JP | 2004303695 | | 10/2004 | |
| JP | 2005069596 | A | 3/2005 | |
| JP | 2005098637 | A | 4/2005 | |
| JP | 2005114015 | | 4/2005 | |
| JP | 2005164193 | | 6/2005 | |
| JP | 2005256849 | | 9/2005 | |
| JP | 2006-///92 | | 3/2006 | |
| JP | 2006161834 | A | 6/2006 | |
| JP | 2006161945 | | 6/2006 | |
| JP | 3792801 | | 7/2006 | |
| JP | 2006200685 | A | 8/2006 | |
| JP | 2007263186 | | 10/2007 | |
| JP | 4111096 | | 7/2008 | |
| JP | 2008157431 | | 7/2008 | |
| JP | 2008190815 | | 8/2008 | |
| JP | 2009063064 | | 3/2009 | |
| JP | 2009162402 | | 7/2009 | |
| JP | 2009524570 | | 7/2009 | |
| JP | 2010017437 | | 1/2010 | |
| JP | 2010071565 | | 4/2010 | |
| JP | 2010108199 | | 5/2010 | |
| JP | 2010145002 | | 7/2010 | |

(56) References Cited

FOREIGN PATENT DOCUMENTS

| | | | | | |
|---|---|---|---|---|---|
| JP | 4545126 | | | 9/2010 | |
| JP | 2010236770 | | | 10/2010 | |
| JP | 2010276309 | | | 12/2010 | |
| JP | 2011002033 | | | 1/2011 | |
| JP | 2011069612 | | | 4/2011 | |
| JP | 4779684 | | | 9/2011 | |
| JP | 2011196644 | | | 10/2011 | |
| JP | 2012026493 | | | 2/2012 | |
| JP | 4897473 | | | 3/2012 | |
| JP | 2012063029 | | | 3/2012 | |
| JP | 2012087993 | | | 5/2012 | |
| JP | 2012163258 | | | 8/2012 | |
| JP | 2012189114 | | | 10/2012 | |
| JP | 2012242075 | | | 12/2012 | |
| JP | 2013002484 | | | 1/2013 | |
| JP | 2013050242 | | | 3/2013 | |
| JP | 2013050267 | A | | 3/2013 | |
| JP | 2013076471 | A | | 4/2013 | |
| JP | 2013088036 | | | 5/2013 | |
| JP | 2013195009 | | | 9/2013 | |
| KR | 20020057547 | | | 7/2002 | |
| KR | 20020080938 | | | 10/2002 | |
| KR | 20030083812 | | | 11/2003 | |
| KR | 20040000126 | | | 1/2004 | |
| KR | 20050095357 | A | | 9/2005 | |
| KR | 100620025 | B1 | | 9/2006 | |
| KR | 20070044024 | | | 4/2007 | |
| KR | 1020070065743 | A | | 6/2007 | |
| KR | 20070111855 | A | * | 11/2007 | ..... F25D 23/028 |
| KR | 20080103845 | | | 11/2008 | |
| KR | 20090026045 | | | 3/2009 | |
| KR | 1017776 | | | 2/2011 | |
| KR | 101017776 | | | 2/2011 | |
| KR | 20120007241 | | | 1/2012 | |
| KR | 20120046621 | | | 5/2012 | |
| KR | 20120051305 | | | 5/2012 | |
| KR | 20150089495 | A | | 8/2015 | |
| RU | 2061925 | C1 | | 6/1996 | |
| RU | 2077411 | C1 | | 4/1997 | |
| RU | 2081858 | | | 6/1997 | |
| RU | 2132522 02 | | | 6/1999 | |
| RU | 2162576 02 | | | 1/2001 | |
| RU | 2166158 | C1 | | 4/2001 | |
| RU | 2187433 02 | | | 8/2002 | |
| RU | 2234645 | C1 | | 8/2004 | |
| RU | 2252377 | | | 5/2005 | |
| RU | 2253792 02 | | | 6/2005 | |
| RU | 2349618 02 | | | 3/2009 | |
| RU | 2414288 02 | | | 3/2011 | |
| RU | 2422598 | | | 6/2011 | |
| RU | 142892 | | | 7/2014 | |
| RU | 2529525 | C1 | | 9/2014 | |
| RU | 2571031 | | | 12/2015 | |
| SU | 203707 | | | 12/1967 | |
| SU | 00476407 | A1 | | 7/1975 | |
| SU | 648780 | A1 | | 2/1979 | |
| SU | 01307186 | A1 | | 4/1987 | |
| WO | 9614207 | A1 | | 5/1996 | |
| WO | 1996032605 | | | 10/1996 | |
| WO | 9721767 | | | 6/1997 | |
| WO | 9920961 | A1 | | 4/1999 | |
| WO | 9920964 | | | 4/1999 | |
| WO | 200160598 | | | 8/2001 | |
| WO | 200202987 | | | 1/2002 | |
| WO | 2002052208 | | | 4/2002 | |
| WO | 02060576 | A1 | | 8/2002 | |
| WO | 03072684 | A1 | | 9/2003 | |
| WO | 2003089729 | | | 10/2003 | |
| WO | 2004010042 | A1 | | 1/2004 | |
| WO | 2006045694 | | | 5/2006 | |
| WO | 2006073540 | A2 | | 7/2006 | |
| WO | 2006120183 | | | 11/2006 | |
| WO | 2006120198 | | | 11/2006 | |
| WO | 2007033836 | A1 | | 3/2007 | |
| WO | 2007085511 | | | 8/2007 | |
| WO | 2007106067 | A2 | | 9/2007 | |
| WO | 2008065453 | | | 6/2008 | |
| WO | 2008077741 | | | 7/2008 | |
| WO | 2008118536 | A2 | | 10/2008 | |
| WO | 2008122483 | A2 | | 10/2008 | |
| WO | 2009013106 | A2 | | 1/2009 | |
| WO | 2009112433 | A1 | | 9/2009 | |
| WO | 2009147106 | | | 12/2009 | |
| WO | 2010007783 | A1 | | 1/2010 | |
| WO | 2010029730 | | | 3/2010 | |
| WO | 2010043009 | | | 4/2010 | |
| WO | 2010092627 | | | 8/2010 | |
| WO | 2010127947 | | | 11/2010 | |
| WO | 2010127947 | A2 | | 11/2010 | |
| WO | 2011003711 | | | 1/2011 | |
| WO | 2011058678 | | | 5/2011 | |
| WO | 2011058678 | A1 | | 5/2011 | |
| WO | 2011081498 | | | 7/2011 | |
| WO | 2012023705 | | | 2/2012 | |
| WO | 2012026715 | | | 3/2012 | |
| WO | 2012031885 | | | 3/2012 | |
| WO | 2012043990 | | | 4/2012 | |
| WO | 2012044001 | | | 4/2012 | |
| WO | 2012085212 | | | 6/2012 | |
| WO | 2012119892 | | | 9/2012 | |
| WO | 2012152646 | | | 11/2012 | |
| WO | 2013116103 | | | 8/2013 | |
| WO | 2013116302 | | | 8/2013 | |
| WO | 2014038150 | | | 3/2014 | |
| WO | 2014038150 | A1 | | 3/2014 | |
| WO | 2014095542 | | | 6/2014 | |
| WO | 2014121893 | A1 | | 8/2014 | |
| WO | 2014184393 | | | 11/2014 | |
| WO | 2014184393 | A1 | | 11/2014 | |
| WO | 2013140816 | A1 | | 8/2015 | |
| WO | 2016082907 | A1 | | 6/2016 | |
| WO | 2017029782 | A1 | | 2/2017 | |

OTHER PUBLICATIONS

Raszewski et al., "Methods For Producing Hollow Glass Microspheres," Powerpoint, cached from Google, Jul. 2009, 6 pages.

* cited by examiner

ATTACHMENT ARRANGEMENT FOR VACUUM INSULATED DOOR

CROSS REFERENCE TO RELATED APPLICATION

The present application is a Continuation of U.S. patent application Ser. No. 15/290,723 filed on Oct. 11, 2016, entitled "ATTACHMENT ARRANGEMENT FOR VACUUM INSULATED DOOR," now U.S. Pat. No. 10,161,669, which issued on Dec. 25, 2018, which is a Continuation-In-Part of U.S. patent application Ser. No. 14/639,617 filed on Mar. 5, 2015 entitled "APPLIANCE DOOR WITH VACUUM INSULATED OUTER DOOR," now abandoned, all of which are hereby incorporated herein by reference.

BACKGROUND OF THE INVENTION

Refrigerators typically include an insulated cabinet structure, an electrically powered cooling system, and one or more doors that are movably mounted to the cabinet structure to provide user access to the refrigerated space within the refrigerator. Known cabinet structures may include a sheet metal outer wrapper and a polymer inner liner. Closed-cell foam or other suitable insulating material is disposed between the metal wrapper and the polymer liner. Refrigerator doors often have a similar construction and include a sheet metal outer wrapper, polymer inner liner, and foam disposed between the sheet metal wrapper and polymer liner.

Refrigerator doors may include one or more shelves that are configured to hold food and/or other items such as jugs of milk and/or other types of cans, jars, and the like. These items may be quite heavy, and refrigerator doors and hinges are typically therefore rigid and structurally sound to support the loads.

SUMMARY OF THE INVENTION

One aspect of the present invention is a refrigerator including an insulated cabinet structure defining a refrigerated interior space having an access opening that permits user access to the refrigerated interior space. A cooling system cools the refrigerated interior space. A door assembly selectively closes off at least a portion of the access opening. The door assembly includes a perimeter structure that is movably mounted to the insulated cabinet structure for movement between open and closed positions. The perimeter structure defines an outer perimeter and a door opening through a central portion of the perimeter structure. At least one shelf is supported by the perimeter structure in the door opening. The door assembly further includes a vacuum insulated outer door that is movably mounted to the perimeter structure whereby the outer door can be moved between open and closed positions relative to the perimeter structure when the perimeter structure is in its closed position. The outer door thereby selectively closes off the door opening without moving the perimeter structure or the shelf. The vacuum insulated outer door includes inner and outer layers that are spaced apart to define a vacuum cavity. Porous core material may be disposed in the vacuum cavity.

These and other features, advantages, and objects of the present invention will be further understood and appreciated by those skilled in the art by reference to the following specification, claims, and appended drawings.

BRIEF DESCRIPTION OF THE DRAWINGS

FIG. 2;

FIG. 6;

FIG. 6;

FIG. 9;

FIG. 9;

DETAILED DESCRIPTION

Figure 1:
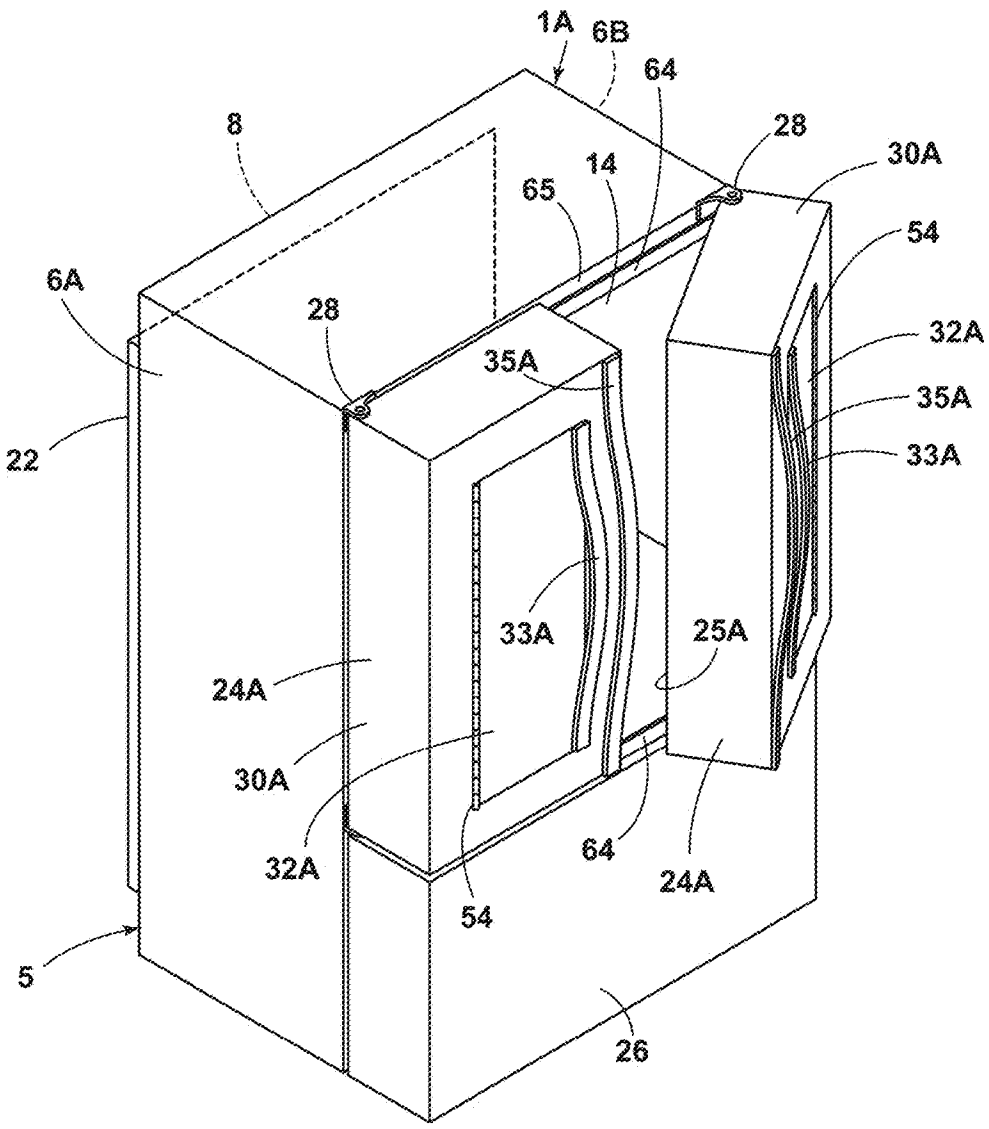
FIG. 1 is an isometric view of a refrigerator according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
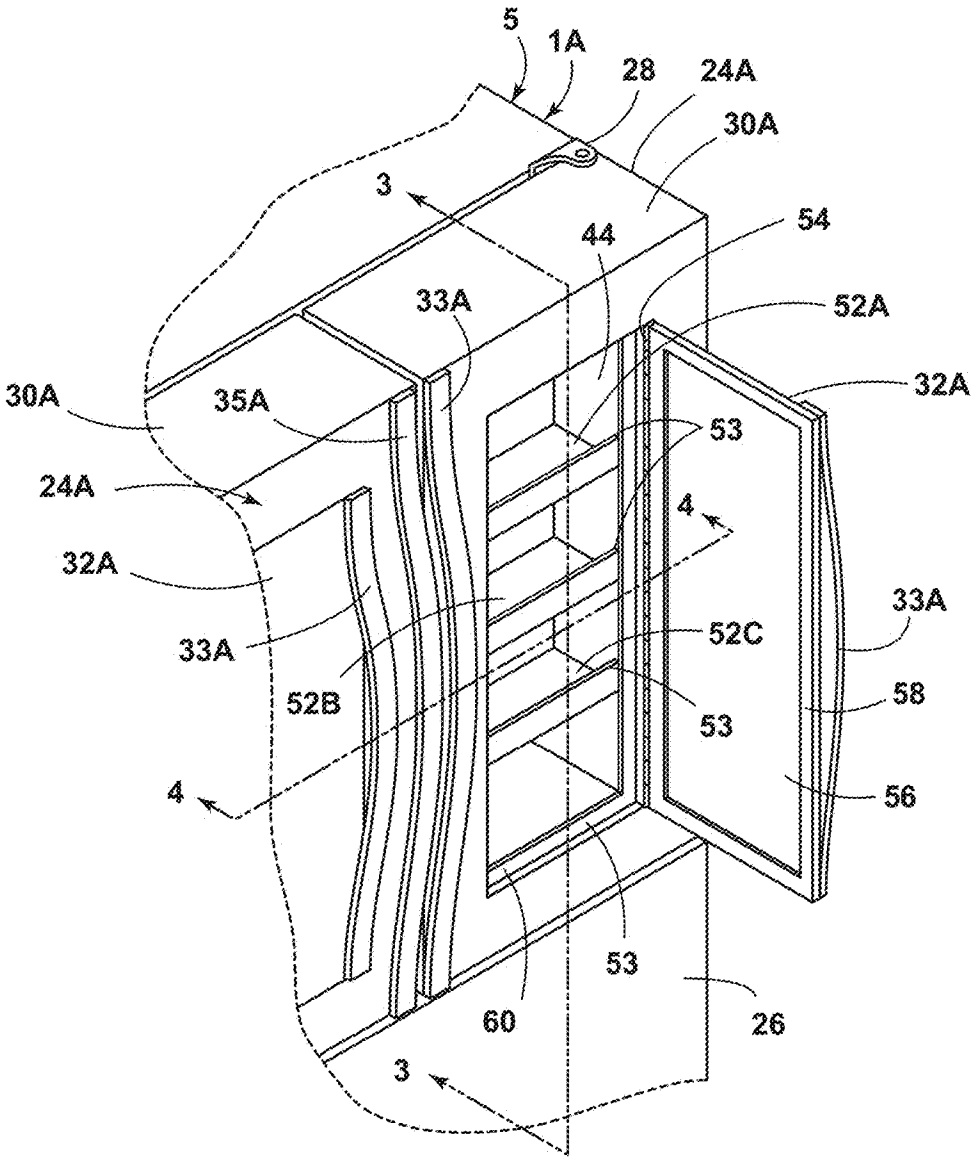
FIG. 2 is a partially fragmentary isometric view of the refrigerator of FIG. 1 showing an outer door in an open position.
Figure 4:
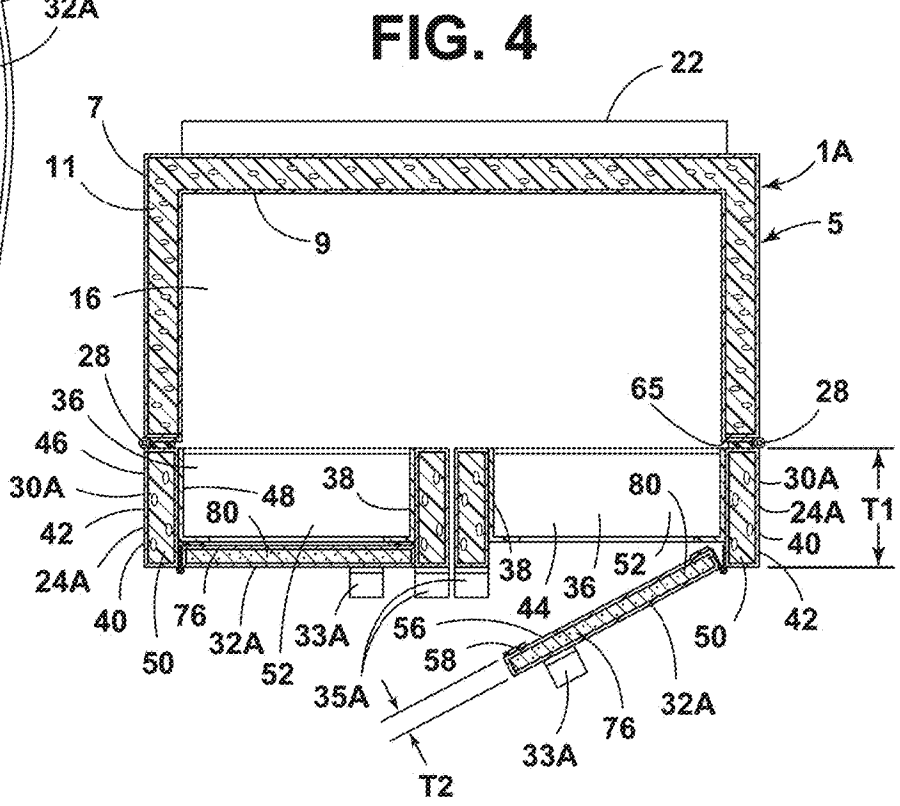
FIG. 4 is a cross sectional view of the refrigerator of FIG. 2 taken along the line 4-4.
Figure 3:
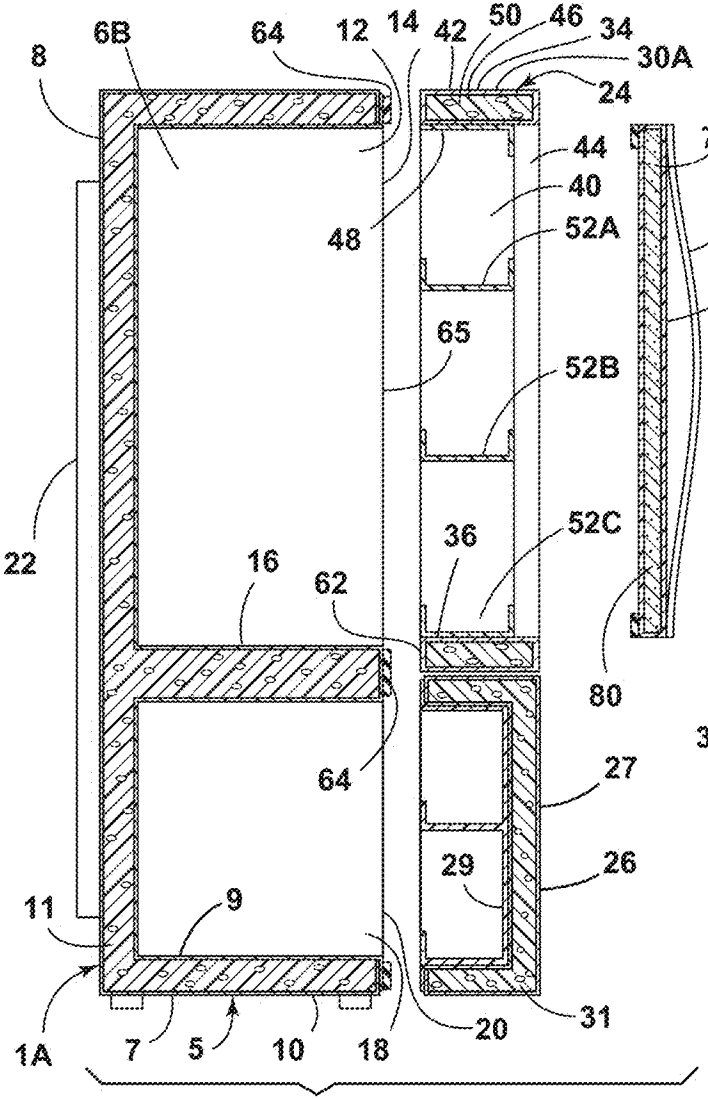
FIG. 3 is a partially exploded cross sectional view of the refrigerator of FIG. 2 taken along the line 2-2 FIG. 2.

With reference to FIGS. 1 and 2, a refrigerator 1A according to one aspect of the present invention includes an insulated cabinet structure 5 including upright side walls 6A and 6B, rear side wall 8 (see also FIGS. 3 and 4), and a generally horizontal lower side wall 10. The cabinet structure defines a refrigerated space or compartment 12 having an access opening 14 to provide user access to the refrigerated compartment 12. Insulated cabinet structure 5 may include a metal outer wrapper or skin 7, a polymer inner liner 9, and a foam core 11. The polymer inner liner may comprise a multilayer thermoformed structure or it may comprise an injection molded structure with high barrier properties. This type of cabinet construction is known in the art, and the details of this construction are therefore not described in detail herein. The insulated cabinet structure 5 may include a divider panel 16 (FIG. 3) that forms a freezer compartment 18 having an opening 20. In the illustrated example, the refrigerated compartment 12 is disposed above the freezer compartment 18. However, it will be understood that insulated cabinet structure 5 may be configured such that the freezer compartment is above the refrigerated compartment 12 or alongside the refrigerated compartment 12. The access opening 14 is selectively closed off by one or more door assemblies 24A, and the opening 20 to freezer compartment 18 is selectively closed off by a freezer door 26. Freezer door 26 may have a conventional construction including a sheet metal outer wrapper 27, a polymer liner 29, and a closed cell foam core 31 as shown in FIGS. 3 and 4.

The refrigerator 1A includes a cooling system 22 that selectively cools the refrigerated compartment 12 and freezer compartment 18. The cooling system 22 may comprise a conventional electrically powered refrigeration system including a controller, sensors, compressor, condenser, and evaporator. Alternatively, the cooling system 22 may comprise thermoelectric cooling elements or other suitable devices.

With reference to FIGS. 1-4, refrigerator 1A includes one or more door assemblies 24A that are configured to close off the access opening 14 of refrigerated compartment 12. Each door assembly 24A includes a perimeter structure 30A, each of which includes a horizontal upper section 34 (FIG. 3), a horizontal lower section 36, and upright side sections 38 and 40 that extend between and interconnect horizontal upper and lower sections 34 and 36, respectively. The horizontal upper and lower sections 34 and 36 and upright side sections 38 and 40 form a quadrilateral outer perimeter 42. Door openings 44 through perimeter structures 30A may also be generally quadrilateral in shape. Perimeter structures 30A have a generally ring-like or hoop-like shape. The shape of perimeter structures 30A may also be somewhat similar to a picture frame when viewed from the front. However, it will be understood that the size, shape, and configuration of perimeter structures 30A may vary as required for a particular application.

The perimeter structures 30A are mounted to the insulated cabinet structure 5 by hinges 28 or other suitable structures for rotation about vertical axes between open and closed positions. The perimeter structures 30A may include a metal outer wrapper or skin 46 and a polymer liner 48 that form a ring-shaped cavity that is at least partially filled with closed-cell polyurethane foam insulation 50 or other suitable insulating material that is disposed between the metal outer wrapper 46 and the polymer inner liner 48. The perimeters of the outer wrapper 46 and the polymer inner liner 48 may be joined/connected utilizing known techniques. One or more supports such as shelves 52A-52C extend horizontally between the upright side portions or sections 38 and 40 in or across door opening 44. Opposite ends 53 of shelves 52A-52C (FIG. 2) may removably/adjustably engage the perimeter structure 30A to permit removal of shelves 52A-52C and/or adjustment of the vertical position of shelves 52A-52C. Alternatively, the opposite ends 53 of shelves 52A-52C may be fixed to perimeter structure 30A. The shelves 52A-52C may be configured to support jugs of milk or other items. The perimeter structure 30A preferably comprises a rigid structure having sufficient strength to support significant amounts of weight on shelves 52.

Outer doors 32A are movably mounted to the perimeter structure 30A for rotation about vertical axes by hinges 54 (FIG. 1). The outer doors 32A have an inner side face 56 that may include a resilient seal 58 that sealingly engage outer side faces 60 (FIG. 1) of perimeter structures 30A. Perimeter structures 30A include ring-shaped inner side faces 62 (FIG. 2) that sealingly engage a resilient seal 64 secured to outer face 65 of cabinet structure 5 when perimeter structures 30A are in their closed positions. It will be understood that seals 64 may alternatively be secured to inner faces 65 of perimeter structures 30A.

Figure 5:
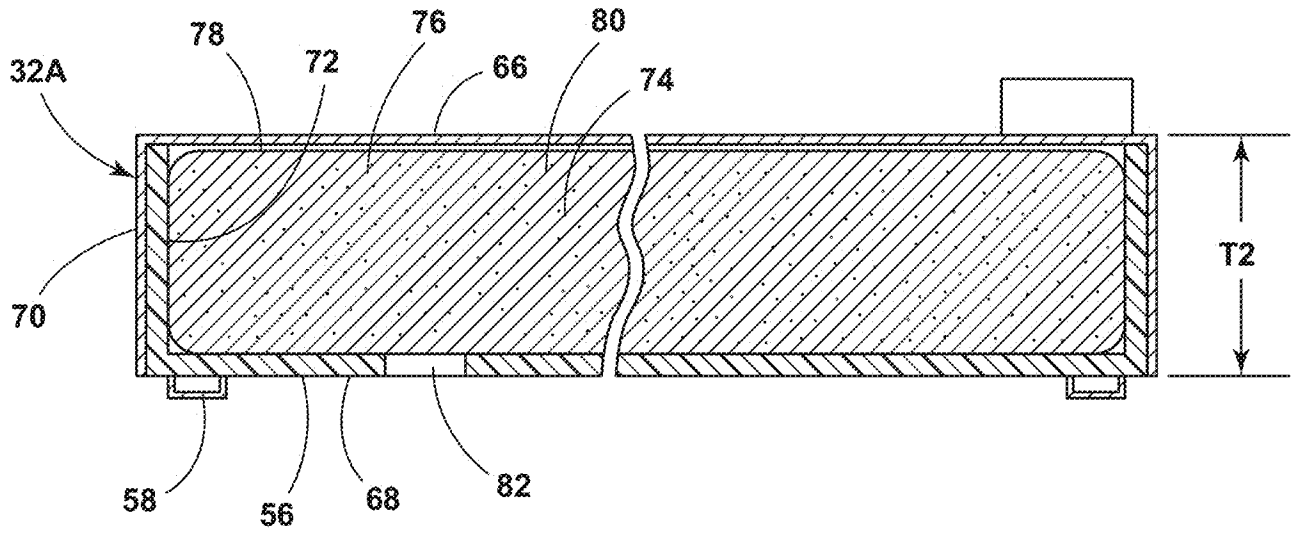
FIG. 5 is fragmentary cross sectional view of the outer door of FIG. 4.

With further reference to FIG. 5, outer doors 32A comprise an outer skin or wrapper 66 that may comprise sheet metal (e.g. steel) or other suitable material. An inner liner 68 is made of a polymer material that may be thermoformed, molded, or otherwise fabricated to provide the required shape/configuration. A perimeter 70 of outer skin 66 may be in the form of a flange that is connected to a perimeter 72 of inner liner 68 that may also comprise a flange. Perimeter 70 may have a quadrilateral shape corresponding to door openings 44. A cavity 74 is defined between the outer skin 66 and inner liner 68. A vacuum core panel 76 is disposed in the cavity 74. The vacuum core panel 76 comprises a porous filler material whereby the cavity 74 can be subject to a vacuum without collapsing the outer skin 66 and inner liner 68.

The vacuum insulated outer doors 32A may be constructed in various ways. For example, the core panel 76 may comprise porous filler material 80 that is disposed inside of a gas impermeable wrapper or envelope 78. Envelope 78 may comprise polymer and/or metal layers that are impermeable to gas. Various suitable envelopes are known in the art, such that the details of envelope 78 are not described in detail. The porous filler 80 may be positioned inside of the envelope 78 prior to assembly of door 32, and the filler 80 may be subject to a vacuum prior to sealing the envelope 78. The core panel 76 can then be positioned between the outer skin 66 and inner liner 68 during assembly, and the outer skin 66 and inner liner 68 can be secured along the perimeters 70 and 72, respectively utilizing adhesives, mechanical connectors, or other suitable means. In this configuration, the envelope 78 provides an airtight, gas-impermeable layer such that the outer skin 66 and inner liner 68 do not necessarily need to be impermeable, and a seal along the perimeters 70 and 72 of outer skin 66 and inner liner 68, respectively, is not necessarily required.

Door 32A may also be constructed by placing solid filler material 80 between the outer skin 66 and inner liner 68. According to this aspect of the present invention, the porous filler material 80 comprises a solid block of material that is preformed (e.g. pressed) into a shape corresponding to cavity 74, and a wrapper or envelope 78 is not required. After the solid block of porous filler 80 is positioned between the outer skin 66 and inner liner 68, the perimeters 70 and 72 are sealed together utilizing adhesive, heat-sealing processes, or the like. The cavity 74 is then subject to a vacuum to remove the air through a vacuum port such as opening 82 in liner 68. The opening 82 is then sealed using a plug or the like (not shown) such that the cavity 74 forms a vacuum.

An outer door 32A according to another aspect of the present invention may be fabricated by first assembling the outer skin or wrapper 66 with the inner liner 68, and forming an airtight seal at the perimeters 70 and 72, respectively utilizing adhesives/sealants, a heat sealing process, or other suitable process/means. Porous filler 80 in the form of loose powder such as fumed silica or other suitable material is then deposited into the cavity 74 through opening 82 or through a feeder port on the wrapper (not shown). The opening 82 is then subject to a vacuum to remove the air from cavity 74, and the opening 82 is then sealed.

Referring again to FIG. 4, the perimeter structures 30A of door assemblies 24A have a thickness "T1" that is significantly greater than the thickness "T2" of the vacuum insulated outer doors 32. The vacuum insulated outer doors 32A may be constructed without shelves or the like such that the vacuum insulated outer doors 32A are not subjected to significant loading. Because beverages and other items are stored on the shelves 52A-52C of perimeter structure 30A, the weight of these items is carried by the perimeter structure 30A and hinges 28, not the vacuum insulated outer doors 32A. Because the perimeter structure 30A includes metal outer wrapper 46, polymer inner liner 48, and polyurethane foam or the like 50, the perimeter structure 30 may be very rigid and structurally sound. Also, this construction does not create issues with respect to potential leakage of vacuum panels in perimeter structure 30A. Because the vacuum insulated outer doors 32A are not subject to significant loading, the integrity of the outer doors 32 is maintained and potential leakage with respect to the vacuum cavities is avoided.

In use, a user can grasp the handles 33A of outer doors 32A to thereby open the outer doors 32A without moving the perimeter structure 30A relative to the insulated cabinet structure 5. A user can then remove items positioned on shelves 52A-52C without moving perimeter structure 30A relative to the insulated cabinet structure 5. As shown in FIG. 2, the door opening 44 may be significantly smaller than the access opening 14 whereby opening outer door 32A reduces the amount of cold air lost from refrigerated compartment 12 (FIG. 3) relative to opening a conventional refrigerator door to thereby open the entire access opening 14. If a user needs to gain access to the refrigerated compartment 12, the user can open the entire door assembly 24 by grasping handle 35A on perimeter structure 30A and rotating perimeter structure 30A about hinges 28. The outer doors 32A may remain in a closed position relative to the perimeter structure 30A while perimeter structure 30A is opened. Shelves 52A-52C can be accessed from the inner side 25A of door assemblies 24A when perimeter structure 30A is rotated to an open position. Thus, outer doors 32A can be left in a closed position, and door assemblies 24A can be opened and used in substantially the same manner as conventional refrigerator doors if a user so chooses. Seals 64 (FIG. 3) between perimeter structures 30A and cabinet 5 may include magnets that retain perimeter structures 30A in a closed position. Similarly, seals 58 of outer doors 32A may also include elongated magnets tending to retain outer doors 32A in a closed position relative to perimeter structures 30A. The magnetic forces of the seals 58 and 64 can be selected such that perimeter structures 30A remain closed when outer doors 32A are opened.

Figure 6:
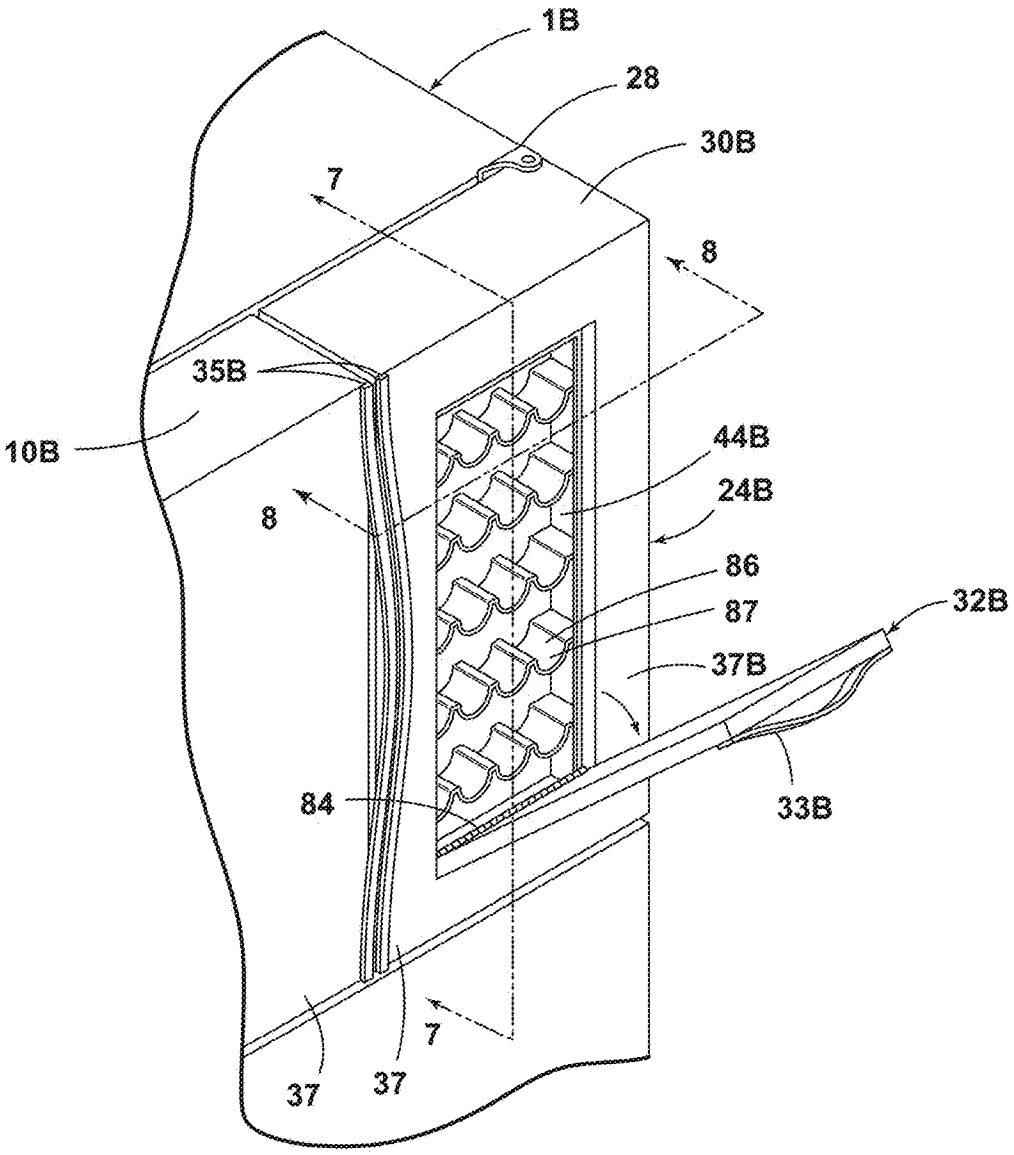
FIG. 6 is a partially fragmentary isometric view of a refrigerator according to another aspect of the present invention.
Figure 8:
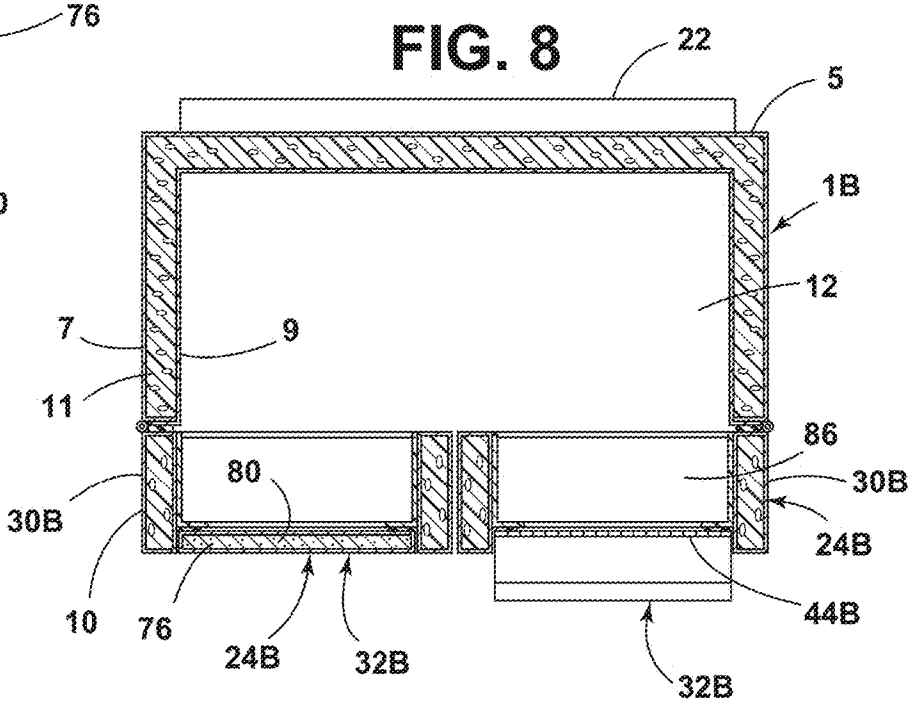
FIG. 8 is a cross sectional view of the refrigerator of FIG. 7 taken along the line 8-8.
Figure 7:
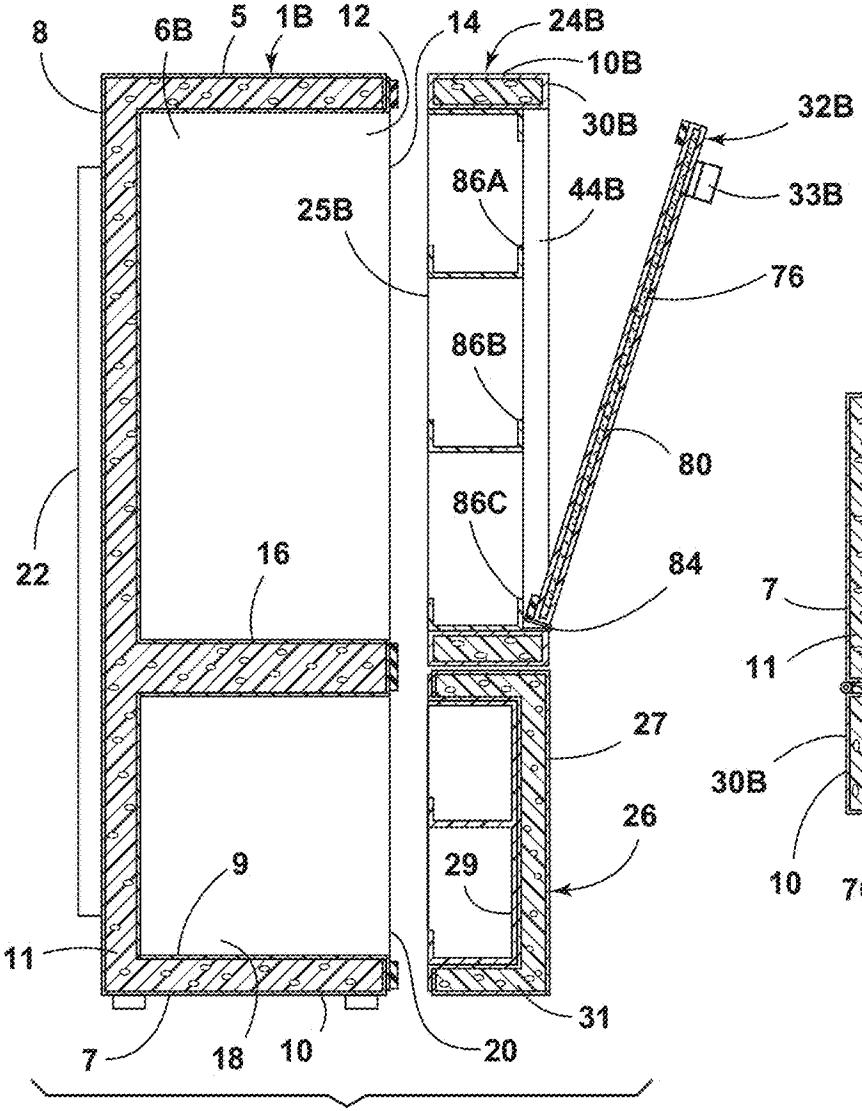
FIG. 7 is a partially exploded cross sectional view of a refrigerator according to another aspect of the present invention taken along the line 7-7.

With further reference to FIGS. 6-8, a refrigerator 1B according to another aspect of the present invention includes a refrigerated cabinet structure 5 that is substantially the same as the cabinet structure 5 described in more detail above in connection with FIGS. 3 and 4. Refrigerator 1B includes at least one door assembly 24B that includes a perimeter structure 30B having substantially the same construction as the perimeter structure 30A described in more detail above. Door openings 44B formed in perimeter structures 30B are selectively closed off by vacuum insulated outer doors 32B. Outer doors 32B are movably mounted to the perimeter structures 30B for rotation about a horizontal axis by hinges 84 positioned along or at lower edges of outer doors 32B. A plurality of racks or shelves 86 extend across the openings 44B of perimeter structures 30B. The racks 86 may include upwardly-facing cylindrical surfaces 87 that are configured to support cans or other beverages on their sides. Alternatively, racks 86 may be in the form of shelves that are configured to support jugs of milk or the like as described above in connection with FIG. 2. Beverages on racks 86 can be accessed by pulling on handle 33B to open the outer door 32B, without opening perimeter structure 30B. The outer door 32B comprises a vacuum insulated structure that may be constructed as discussed in more detail above in connection with FIG. 3A. Handles 35B may be mounted to ring-shaped vertical outer side faces 37 of perimeter structures 30B whereby a user can pull on handles 35B to open perimeter structures 30B. As perimeter structures 30B are opened, outer doors 32B move with perimeter structure 30B, such that door assemblies 24B can operate in a manner that is similar to conventional refrigerator doors. When perimeter structure 30B is opened, racks 86 can be accessed.

Figure 9:
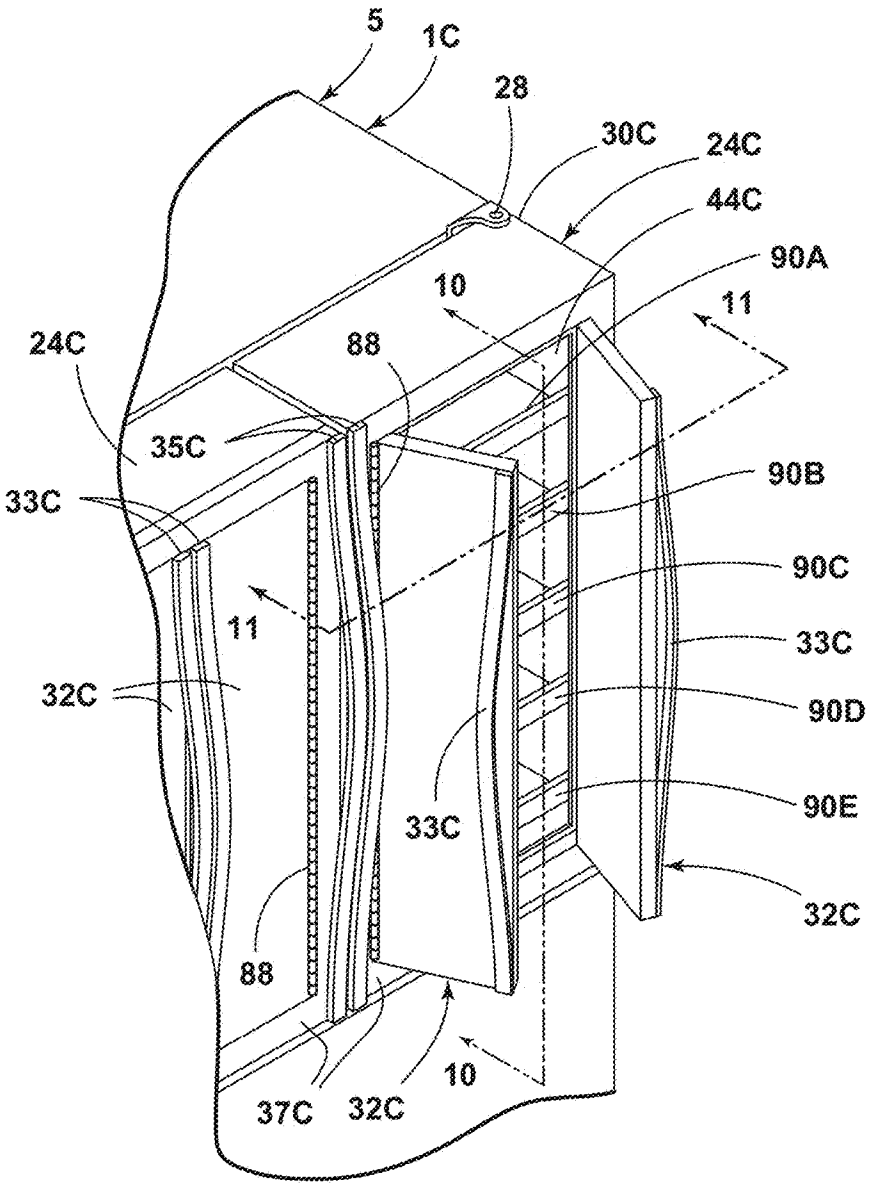
FIG. 9 is a partially fragmentary isometric view of a refrigerator according to another aspect of the present invention.
Figure 11:
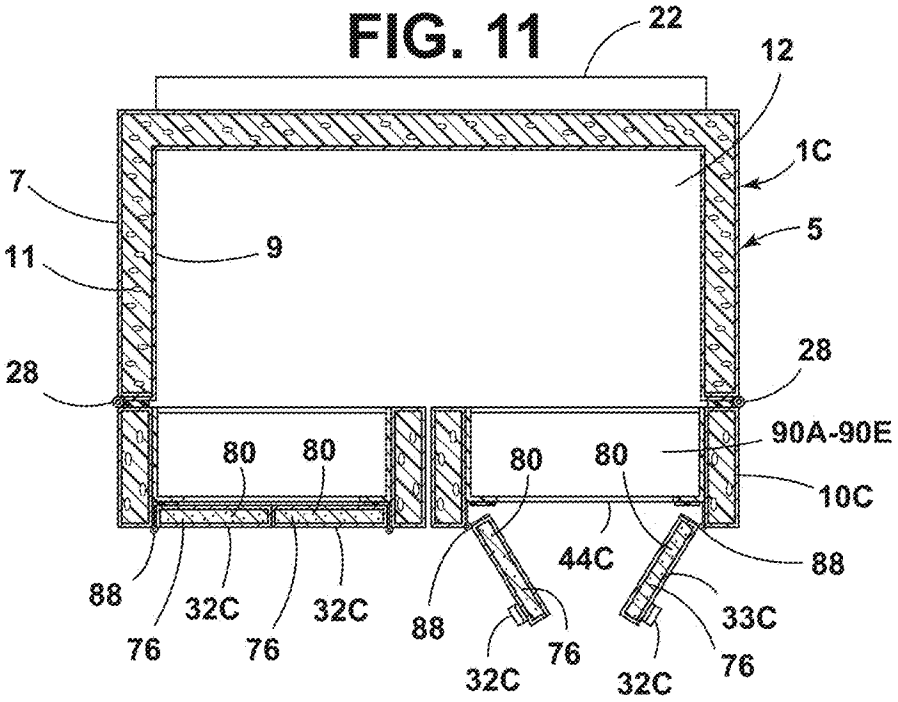
FIG. 11 is a cross sectional view of the refrigerator of FIG. 10 taken along the line 11-11.
Figure 10:
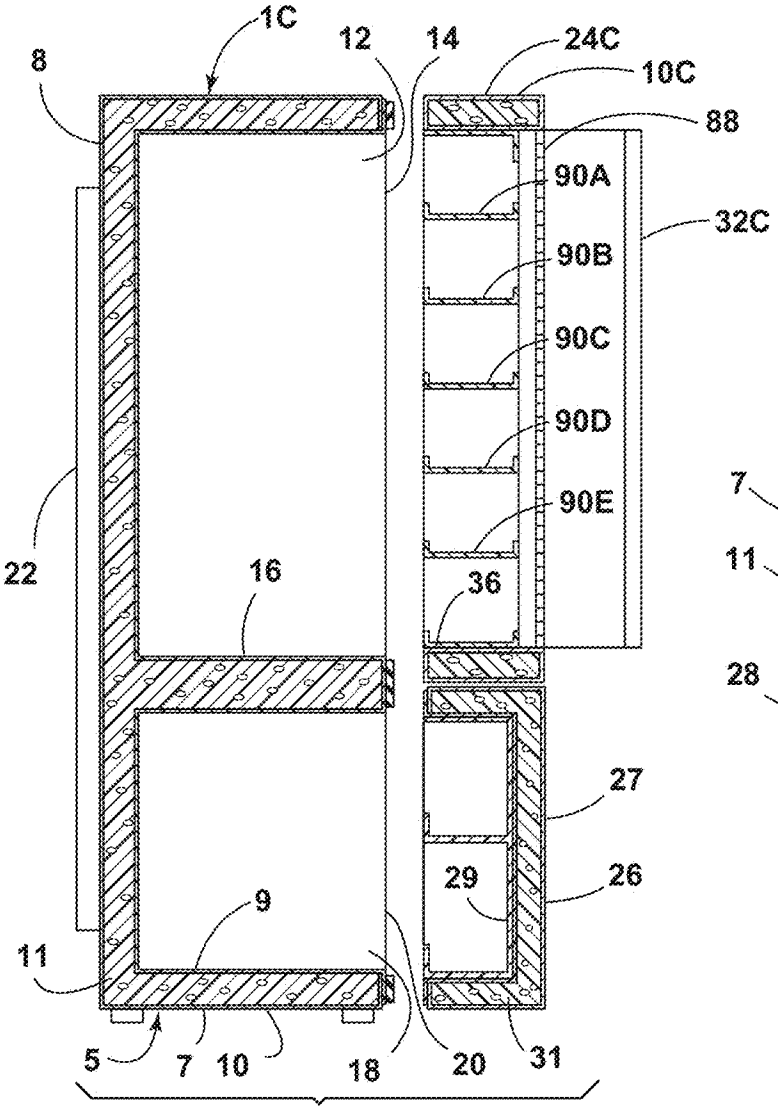
FIG. 10 is a partially exploded cross sectional view of a refrigerator according to another aspect of the present invention taken along the line 10-10.

With further reference to FIGS. 9-11, a refrigerator 1C according to another aspect of the present invention includes a pair of door assemblies 24C. The door assemblies 24C include perimeter structures 30C that are substantially similar to the perimeter structure 30A described in more detail above in connection with FIGS. 1A, 2 and 3. Handles 35C are disposed on outer side faces 37C of perimeter structures 30C. Each door assembly 24C includes a pair of outer doors 32C that are movably mounted to the perimeter structure 30C by hinges 88 for rotation about vertical axes. A plurality of racks or shelves 90A-90E extend across the openings 44C to thereby support beverages or other items on perimeter structure 30C. The outer doors 32C may comprise vacuum insulated structures that are constructed in substantially the same manner as outer doors 32A as described above in connection with FIGS. 3-5.

In use, one or more of the outer doors 32C may be opened using handles 33C without moving perimeter structure 30C relative to the insulated cabinet structure 5 if a user needs to access items on shelves 90A-90E. Alternatively, a user can move the perimeter structure 30C relative to the insulated cabinet structure 5 by grasping handles 35C and rotating the perimeter structure 30C about hinges 28.

Figure 12:
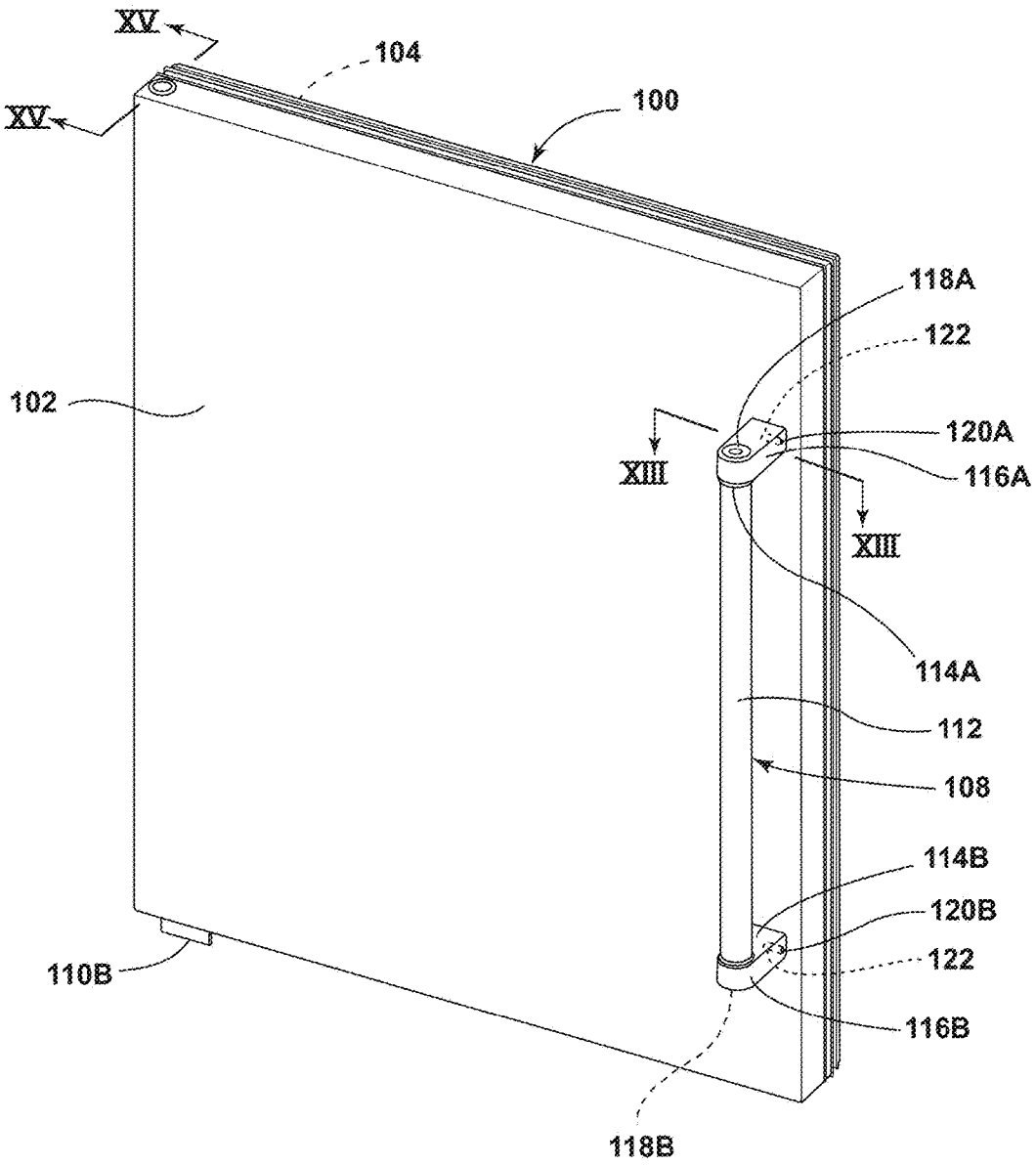
FIG. 12 is an isometric view of a vacuum insulated door according to another aspect of the present disclosure.
Figure 13:
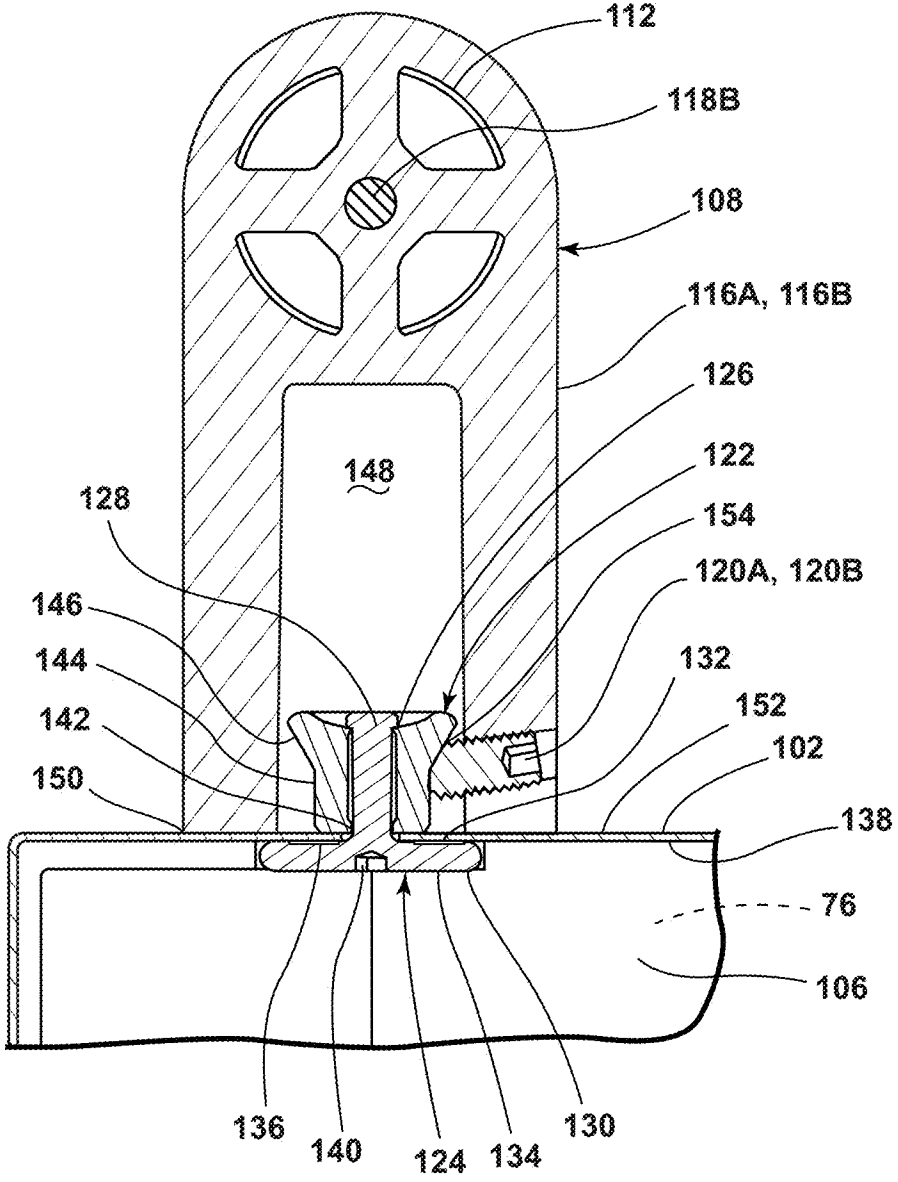
FIG. 13 is a cross sectional view of the door of FIG. 12 taken along the line XIII-XIII.

With further reference to FIG. 12, a vacuum insulated door 100 according to another aspect of the present disclosure includes an outer layer 102 that is secured to an inner layer 104 to form a vacuum cavity 106 (FIG. 13). The outer layer 102, inner layer 104, and vacuum cavity 106 may be constructed in substantially the same manner as the corresponding components described in more detail above in connection with FIGS. 1-11. In particular, the outer layer 102 may comprise sheet metal, and the inner layer 104 may comprise a polymer material as discussed in more detail above in connection with FIG. 5. Vacuum insulated door 100 may include a vacuum core panel 76 that is disposed in the vacuum cavity 106. The core panel 76 may comprise porous filler material 80 (FIG. 5) in the form of powder or a solid material.

The vacuum insulated door 100 includes a handle assembly 108 and hinge attachments 110A and 110B that are sealingly connected to the door in a manner that ensures that air and/or other gasses do not enter the vacuum cavity 106. Handle assembly 108 includes an elongated central portion 112 that may comprise a tube or other suitable construction. Upper and lower ends 114A, 114B, of central portion 112 are press fit into upper and lower brackets 116A and 116B by connectors 118A and 118B. As discussed in more detail below, set screws 120A and 120B engage projections such as a nut 122 (FIG. 13) that is secured to outer layer 102 of door 100 by an insert 124. The nuts 122 have a shape that is substantially identical to the head of existing screws (not shown) utilized in conventional (non vacuum-insulated) refrigerator doors. Thus, the central portion 112 of handle assembly 108, brackets 116A, 116B, connectors 118A, 118B, and set screws 120A and 120B may be substantially identical to known handle assemblies utilized in conventional (non vacuum-insulated) refrigerator doors.

Figure 17:
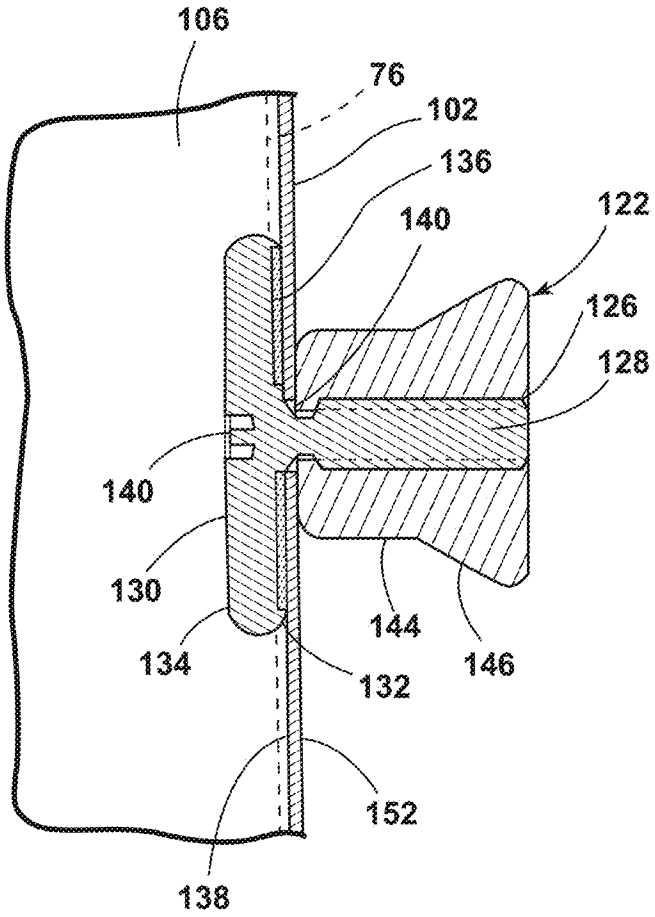
FIG. 17 is a partially fragmentary cross sectional view of a portion of the door of FIG. 16 taken along the line XVII-XVII.
Figure 16:
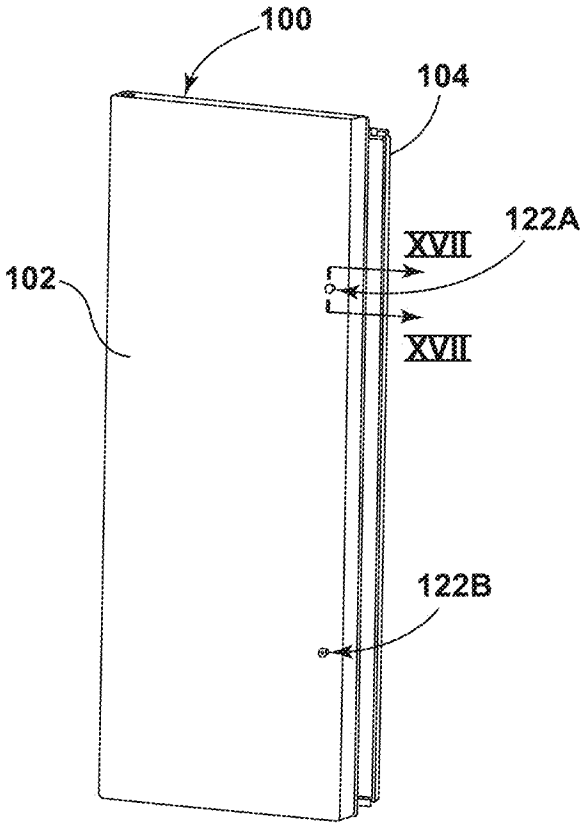
FIG. 16 is an isometric view of a vacuum insulated door according to another aspect of the present disclosure.

With reference to FIGS. 13, 16, and 17, nut 122 includes a threaded opening 126 that threadably engages a threaded boss 128 of insert 124. Insert 124 also includes an inner portion 130 that may be substantially disc-shaped with an inner side 132 and an outer side 134. A resilient seal material 136 is disposed between inner side 132 of inner portion 130 of insert 124. The resilient seal material 136 may be in the form of a preformed flat washer or ring that is made of a resilient rubber or polymer material. Alternatively, resilient seal material 136 may also be in the form of flowable (high viscosity) adhesive sealant that is applied between the two surfaces which hardens in order to form the seal. Insert 124 may include a hex cavity 140 or other suitable feature that permits torque to be applied to the insert 124 during assembly.

During assembly, the boss 128 of insert 124 is inserted through an opening 142 in outer layer 102 of door 100, and threaded boss 128 is threadably engaged with threaded opening 126 of nut 122. Nut 122 and insert 124 are then rotated relative to one another, thereby clamping the resilient seal 136 tightly between inner side 132 of inner portion 130 of insert 124 and inner surface 138 of outer layer 102 to thereby seal the opening 142 in outer layer 102. Nut 122 includes a cylindrical inner portion 144 and a tapered outer portion 146. The tapered outer portion 146 is preferably conical in shape. The shapes and sizes of portions 144 and 146 are substantially identical to corresponding surfaces of nuts utilized in conventional (non vacuum-insulated) doors. However, it will be understood that nuts utilized in conventional refrigerator doors do not provide an airtight seal, and these prior nuts are therefore typically not suitable for use in vacuum insulated doors. During assembly, after nuts 122 and inserts 124 are installed in upper and lower openings 142 of outer layer 102 (FIG. 16), brackets 116A and 116B are then positioned over the nuts 122 in cavities 148 of brackets 116A and 116B. When brackets 116A and 116B are in the installed position, end surfaces 150 of brackets 116A and 116B bear against outer surface 152 of outer layer 102. The set screws 120A and 120B are then tightened, such that the ends 154 of the set screws 120 bear against tapered surface 146 of nut 122, thereby generating a force tending to draw the brackets 116A and 116B towards the outer layer 102 of door 100. Ends 154 of set screws 120A and 120B may also engage cylindrical inner surface portion 144 of nuts 122.

Figure 15:
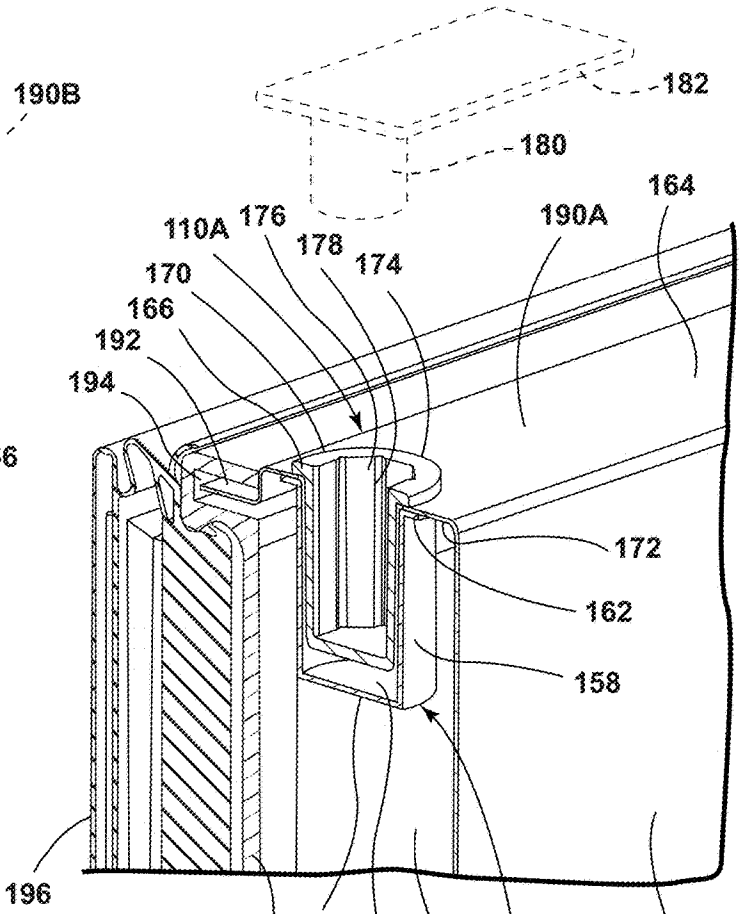
FIG. 15 is a partially fragmentary cross sectional view of a portion of the door of FIG. 12 taken along the line XV-XV.
Figure 14:
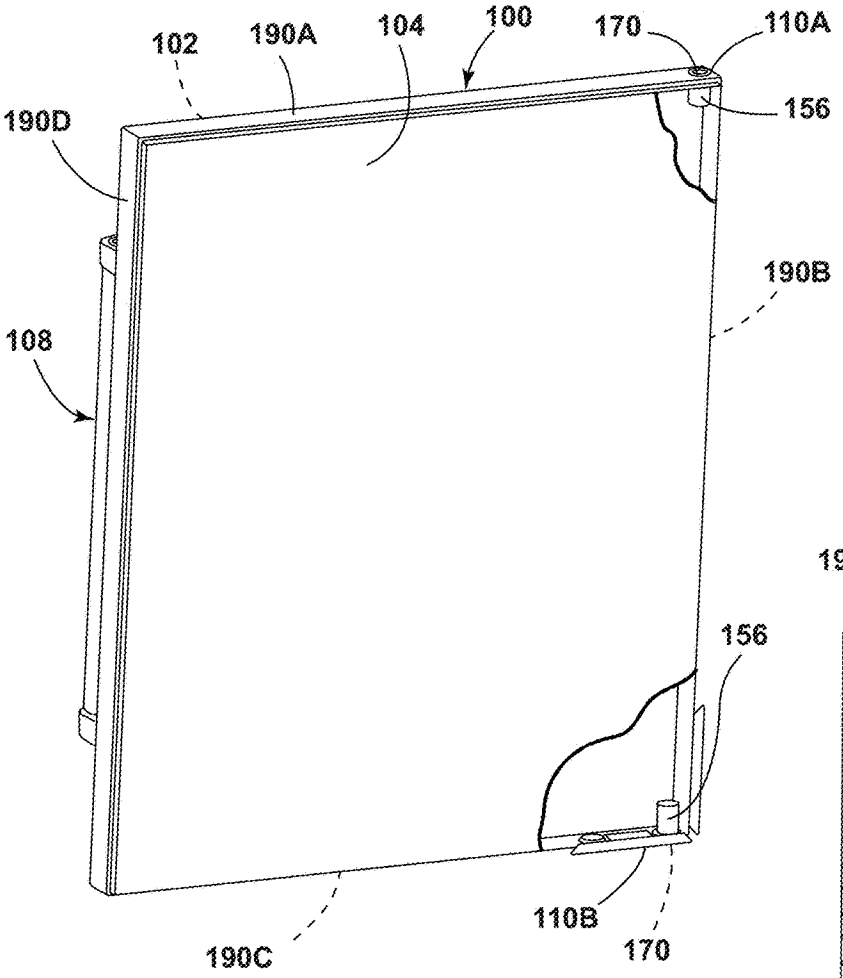
FIG. 14 is an isometric view of the door of FIG. 12.

With reference to FIGS. 14 and 15, the outer layer 102 of vacuum insulated door 100 includes flanges 164 that form transverse edge portions 190A-190D of door 100. The hinge attachments 110A and 110B are connected to upper and lower edge portions 190A and 190C, respectively, of door 100 at openings 166 in flange 164. Upper hinge attachment 110A includes a cup-shaped metal inner member 156 (FIG. 15) having a hollow construction with a tubular portion 158, an end 160, and a flange 162. Flanges 162 are welded to an inner surface of flange 164 at opening 166 to form a sealed connection therewith. An insert 170 is received in cavity 168 of inner member 156. Insert 170 is made of a suitable material such as a low friction polymer material, and includes a flange 174 that slidably engages flange 164 of outer layer 102 of door 100. Insert 172 also includes an inner surface 176 having a plurality of flat surfaces 178 that rotatably engage a pin 180 that is secured to the main refrigerator cabinet by a bracket 182. The pin 180 and bracket assembly 182 may be substantially similar to the hinges 28 (FIGS. 1 and 2), or other suitable shape/configuration as required for a particular application. Referring again to FIG. 14, inner members 156 may be welded to the upper edge 190A and lower edge 190B of door 100 in substantially the same manner to provide pivoting interconnection with upper and lower pins and brackets 180 and 182.

Referring again to FIG. 15, outer layer 102 may comprise sheet metal that is formed to include a flange 164 forming edges 190A-190D. The outer member 102 may also include an edge flange 192 that is received in a channel 194 of inner layer or member 104. The channel 194 may be filled with an adhesive/sealant (not shown) to provide an airtight seal between outer layer 102 and inner layer 104. An inner seal assembly 196 may be secured to the inner layer or member 104 to provide an airtight seal around the peripheral edge of door 100 at the surface where door 100 contacts the opening in the parameter structure of the door assembly.

It will be understood that the vacuum insulated door 100 may comprise an outer door assembly (e.g. outer doors 32A of FIG. 1) that are mounted to perimeter structures 30A (FIG. 1), or the vacuum insulated door 100 may comprise a main refrigerator door that is pivotably connected directly to a refrigerator cabinet structure.

Figure 19:
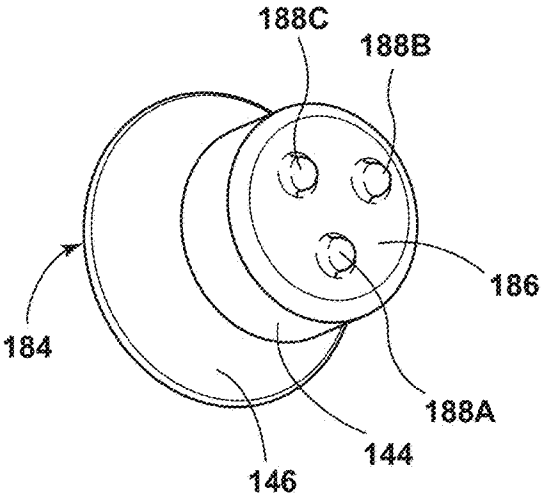
FIG. 19 is an isometric view of the nut of FIG. 18.
Figure 18:
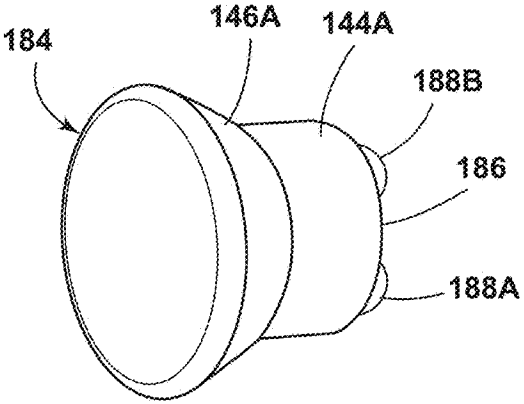
FIG. 18 is an isometric view of a projection or nut according to another aspect of the present disclosure.

With further reference to FIGS. 18 and 19, a nut 184 according to another aspect of the present disclosure includes a cylindrical outer surface 144A and a conical surface 146A that have substantially the same size and configuration as the surfaces 144 and 146, respectively, of nut 122. End 186 of nut 184 includes raised portions 188A, 188B, and 188C. Raised portions 188A, 188B, and 188C may be dome-shaped or other suitable shape. During assembly, the nut 184 is positioned against outer layer 102 of door 100, and the nut 184 is welded to the outer layer 102 such that the raised portions 188A-188C at least partially melt and join to the outer layer 102. The nut 184 and outer layer 102 are preferably made of substantially the same material (e.g. steel), such that the welding process results in the nut 184 joining with the outer layer 102 to provide a substantially one-piece construction.

Figure 21:
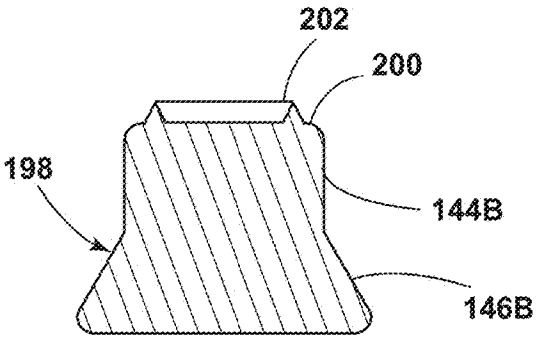
FIG. 21 is a cross sectional view of the nut of FIG. 20 taken along the line XXI-XXI.
Figure 20:
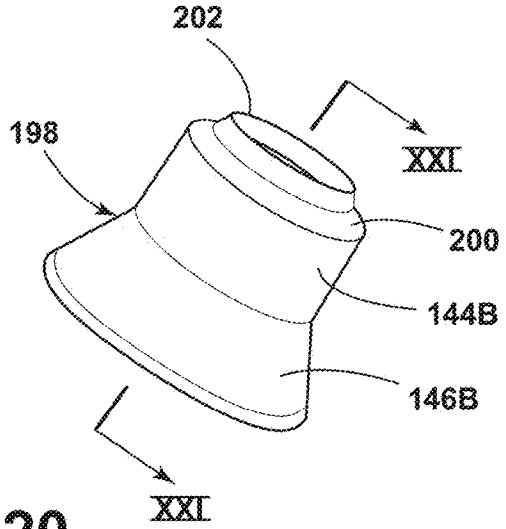
FIG. 20 is an isometric view of a nut according to another aspect of the present disclosure.

With further reference to FIGS. 20 and 21, a nut 198 according to another aspect of the present disclosure includes outer surfaces 144B and 146B that are substantially similar to the outer surfaces 144 and 146 of nut 122. The nut 198 is formed of metal (e.g. steel), and includes a raised ridge 202 at an end 200 of nut 198. The nut 198 is assembled to outer layer 102 of door 100 by welding the raised ridge 202 to the outer layer 102 to form a one piece welded member or assembly.

During assembly of vacuum insulated door 100, the handle 108 is assembled by positioning the brackets 116A and 116B over a nut 184 or a nut 198 in substantially the same manner as discussed above in connection with the nuts 122 of FIG. 13. One or more set screws 120A, 120B are then tightened to engage the tapered surface 146A of a nut 184, or a tapered surface 146B of a nut 198.

It will be understood that the features described in connection with the various embodiments of the present invention are not necessarily mutually exclusive. For example, a refrigerator having an insulated cabinet 5 could include combinations of perimeter structures 10A-10C and outer doors 32A-32C as required for a particular application.

The invention claimed is:

1. A refrigerator, comprising:

an insulated cabinet structure defining a refrigerated interior space having an access opening that permits user access to the refrigerated interior space;

a cooling system that is configured to cool the refrigerated interior space;

a door assembly that selectively closes off at least a portion of the access opening, wherein the door assembly includes a door structure including an inner layer and an outer layer, the door structure further including transverse metal edge flanges extending between the inner and outer layers to define a peripheral edge of the door structure, wherein the door structure forms an airtight cavity, and having porous filler material disposed in the airtight cavity, and wherein the airtight cavity defines a vacuum tending to collapse the inner layer and the outer layer, and wherein the porous filler material supports the inner layer and the outer layer to prevent collapse thereof, the door assembly further comprising a first hinge structure having at least one cup-shaped metal inner member having a closed inner end and an open outer end, the open outer end including a transverse flange overlapping a portion of one of the transverse metal edge flanges of the door structure, wherein the transverse flange of the cup-shaped metal inner member is welded to said one of the transverse metal edge flanges and forms an airtight sealed connection;

a second hinge structure including a bracket secured to the insulated cabinet structure and a pin received in the open outer end of the at least one cup-shaped inner member to rotatably interconnect the door assembly to the insulated cabinet structure;

a low-friction insert disposed in the at least one cup-shaped inner member, and wherein the pin engages the low-friction insert;

the low-friction insert includes a plurality of flat surfaces configured to slidably engage the pin;

the low-friction insert comprises a low-friction polymer material;

the door structure includes four said transverse metal edge flanges including oppositely-facing upper and lower said transverse metal edge flanges;

the door assembly includes cup-shaped metal inner members welded to the upper and lower said transverse metal edge flanges;

one of the inner and outer layers includes a channel that receives an edge flange of the other of the inner and outer layers; and including:

adhesive sealant disposed in the channel and forming an airtight seal;

the door structure includes at least one projection that is secured to the outer layer without penetrating the airtight cavity formed by the inner layer and the outer layer such that gas cannot enter the airtight cavity, the door assembly further including a handle secured to the at least one projection;

wherein the door assembly further includes a perimeter structure having a ring-shaped cavity that is filled with closed-cell foam insulation, wherein the perimeter structure is movably mounted to the insulated cabinet structure and defines a door opening through a central portion of the perimeter structure;

and wherein the door structure is movably mounted to the perimeter structure to selectively close of the door opening of the perimeter structure.

2. The refrigerator of claim 1, wherein:

the perimeter structure includes at least one shelf extending across the door opening of the perimeter structure.

* * * * *